US005306435A

United States Patent [19]

Ishikawa et al.

[11] Patent Number: 5,306,435

[45] Date of Patent: Apr. 26, 1994

[54] TREATING AGENT COMPOSITION FOR LEATHER, FOR FIBROUS MATERIALS

[75] Inventors: Mitsuo Ishikawa, Tokyo; Ikumi Ohnuki, Narashino; Tomoya Ishiyama, Tokyo; Toshiaki Matsuura, Osaka, all of Japan

[73] Assignees: Nihon Junyaku Co., Ltd.; Alota Co., Ltd., both of Tokyo, Japan

[21] Appl. No.: 913,187

[22] Filed: Jul. 14, 1992

[30] Foreign Application Priority Data

Jul. 11, 1991 [JP] Japan ..... 3-203967
Aug. 23, 1991 [JP] Japan ..... 3-236954

[51] Int. Cl.[5] ..... D06M 15/12

[52] U.S. Cl. ..... 252/8.57; 252/8.6; 8/94.1 R; 8/94.29; 8/115.6; 8/115.7; 8/436; 8/437

[58] Field of Search ..... 252/8.57, 8.6; 8/94.1, 8/94.29, 115.6, 115.7, 436, 437

[56] References Cited

U.S. PATENT DOCUMENTS

| | | | |
|---|---|---|---|
| 3,870,554 | 3/1975 | Minklei et al. | 8/94.1 R |
| 4,049,379 | 9/1977 | Erdmann et al. | 8/94.29 |
| 4,150,946 | 4/1979 | Neel et al. | 8/115.6 |
| 4,221,564 | 9/1980 | Plaffer et al. | 8/94.29 |
| 4,264,319 | 4/1981 | Plaffer et al. | 8/94.29 |
| 4,272,242 | 6/1981 | Plaffer et al. | 8/94.29 |
| 4,314,975 | 2/1982 | Motov et al. | 8/94.29 |
| 4,504,271 | 3/1985 | Motov et al. | 8/94.29 |
| 4,622,156 | 11/1986 | Randall | 8/94.29 |
| 4,629,616 | 12/1986 | Ostertag et al. | 8/94.29 |
| 4,731,089 | 3/1988 | Covington | 8/94.29 |
| 4,914,764 | 4/1990 | Mast et al. | 8/436 |

FOREIGN PATENT DOCUMENTS 3265700 11/1991 Japan .
0621725 8/1978 U.S.S.R. .

*Primary Examiner*—Paul Lieberman
*Assistant Examiner*—Michael P. Tierney
*Attorney, Agent, or Firm*—Wenderoth, Lind & Ponack

[57] ABSTRACT

A composition for treating leather, fur and fibrous material which comprises a water-soluble and/or a water-dispersible polyurethane, and more particularly a composition comprising the following ingredients a), b), c) and d) in the following proportions:

| | | |
|---|---|---|
| ingredient a); | water-soluble and water-dispersible polyurethane | 5.0–100% by wt. |
| ingredient b); | salt of divalent to tetravalent metal | 0.0–20% by wt. |
| ingredient c); | surfactant | 0.0–40% by wt. |
| ingredient d); | auxiliary ingredients | 0.0–40% by wt. |

Leather and fur treated with the treating agent of the invention can be washed in water. Even when washed in water, they retain flexibility, have an excellent dimensional stability and are enhanced in water absorption into leather fiber. Further, they are improved in tear strength, tensile strength and hand and become easy to sew by means of a domestic sewing machine. When woven, knit and unwoven fabrics made of natural fibers such as animal hair, wool, silk, cotton and the like or their mixed fabrics with synthetic fibers are treated with the treating agent of the invention, a dimensional stability and shrink resistance after washing can be given to them without affecting their hand.

10 Claims, No Drawings

TREATING AGENT COMPOSITION FOR LEATHER, FOR FIBROUS MATERIALS

BACKGROUND OF THE INVENTION

1. Field of the Invention

The present invention relates to a shrinkproofing agent for leather, fur and woven, knit and unwoven products of natural fibers which makes these material resistant to the change in flexibility upon washing in water. More particularly, the present invention relates to a treating agent composition for leather, fur and fibrous material (hereinafter, the composition is simply referred to as "the treating agent") which, when used for treatment of leather, fur and woven, knit and unwoven fabrics of natural fibers such as animal hair, wool, silk, flax, cotton and the like or their mixed yarn fabrics with synthetic fibers at the time of washing these materials in water, can maintain the flexibility of these materials, give them excellent dimensional stability and shrink resistance and enhance their water absorption, as well as to a method for the treatment using the treating agent.

If leather, fur, and woven, knit or unwoven fabric of fibrous material is treated with the treating agent, these materials can be improved in tear strength, tensile strength and flexibility. In addition, in case of leather, a treatment with the treating agent makes easy the sewing work using a domestic sewing machine.

2. Prior Art Description

It has hitherto been considered that leather, fur and woven, knit and unwoven fabrics made of animal hair, wool, silk or natural cellulose fibers are difficult to wash in water because of hardening and shrinkage. Some of the synthetic fibers have also been in a similar situation. In the case of leather and fur, there has been an attempt to enable washing of these materials in water by sufficiently carrying out reliming or enzymic treatment in the stage of raw skin, thereafter tanning it and fatting it with Turkey red oil or the like. This method, however, has been unable to solve the problem that the material hardens and shrinks when washed in water only once or several times. In unavoidable cases, these materials have been cleaned by the method of dry cleaning or powder method. These methods, however, have been unable to remove water-soluble stains.

The surface of animal hair or wood is covered by a scale (cuticle). If the scale is entangled, it forms a felt which does not return to the original state. The felt formation is particularly marked in the process of drying the material after dipping it in water or washing it in water. In case of silk, flax, cotton and the like, too, dipping in water causes swelling and extension, and drying causes a shrinkage. In case of wool, methods for preventing the shrinkage by removing the scale (cuticle) of the surface have been devised. Thus, enzymic treatment, chlorine treatment and the like are carried out as means therefor, and the anisotropy in the coefficient of friction is reduced and the entanglement between fibers is prevented by Dylan FTC method, DCCA method or protein method. However, these methods are disadvantageous in that they make the fibrous material slippy and readily fraying. Apart from the above, the resin method can be referred to, which comprises bonding together fibers with a resin and coating the scale (cuticle) with it. The chlorinated resin method of IWS, the Kroy/resin method, the Sirolan BAP method and the DC-109 method belong to this type of methods.

However, these methods are disadvantageous in that the fiber hardens and the hand is deteriorated. In cellulose fibers such as cotton, it has been conventional to stabilize the form by mercerization, hot water treatment, etc.

PROBLEM TO BE SOLVED BY THE INVENTION

1 It is intended in the invention to solve the problem that leather and fur produced according to prior methods harden and shrink after washing in water and thereby their uses have been restricted greatly. For solving the problem, in invention provides a treating agent with which leather and fur can easily be washed in water in usual families, as well as leather and fur treated with the treating agent.

2 Leather and fur which have been treated with the treating agent of the invention are greatly improved in the water-absorption in the reticular layer. Accordingly, the present invention makes it possible to utilize effectively the in-process products, semi-finished products and waste materials of finished products including split leather, blue split leather, cutting waste, trimming waste, shaving waste, punching waste and the like. These leather wastes are mechanically or chemically disintegrated and pulverized into powder, after which fiber is taken out and made into a pulp-like material. It can be formed into paper or mat by a procedure similar to that in paper-making or production of unwoven fabric, and used as sound-absorbent material, wall covering material, FUSUMA material, fiber cloth or fabric, and the like. It is also usable as a pigment for coating materials.

3 According to the present invention, a dimensional stability and a shrink resistance are given to woven, knit and unwoven fabrics of natural fibers and their mixed yarn fabrics with synthetic fibers after washing in water, without affecting their hand. Removal of scale (cuticle) from animal hairs and wool is by no means intended in the invention. According to the invention, a water-soluble polyurethane and/or a water-dispersible polyurethane is fixed on a fiber which has been swollen and extended in water, and thereby the shrinkage of fiber occurring in the process of drying is prevented, the dimension is stabilized, and the entanglement between fibers is prevented.

According to the treating method of the present invention (hereinafter simply referred to as "the treating method"), a material to be treated, i.e. fibrous materials including leather, fur, woven, knit and woven fabrics made of natural fiber or mixed yarn of natural and synthetic fibers, raw yarn, spun yarn and the like, is dipped in a solution prepared by diluting the treating agent with water or dispersing it into water and the treating agent is made to adhere to the fibrous material in the presence of water, whereby the material to be treated which has been swollen and extended in water can be prevented from shrinkage in the process of drying and immobilized while keeping its extended dimension. Thus, a shrink resistant effect is exhibited.

When the material which has been treated with the treating agent is leather or fur, it does not lose the shrink resistant effect even if repeatedly washed in water 10 times or more and dried in exposure to direct sunlight. When the material is a woven, knit or unwoven fabric made of natural fiber or mixed yarn of natural and synthetic fiber, it does not lose the shrink resistant effect even if repeatedly washed in water several times and dried in direct sunlight. Further, a material which has once shrunk can be returned nearly to the original dimension by treating it according to this treating method. This treatment does not deteriorate the hand, but the treatment rather improves the hand.

Since the treatment using the treating agent uses no organic solvent unlike dry cleaning process, it necessitates no particular apparatus and it can be practiced with safety even in usual homes. Further, auxiliary ingredients such as detergent, water repellent, ultraviolet absorber, perfume, microbicide, whitening agent, solubilizer, fixation improver and the like can arbitrarily be incorporated into the composition.

Japanese Patent No. 913790 discloses a method for treating fiber materials which comprises using a treating solution into which is compounded a hydrophilic and thermally reactive urethane composition. According to the method mentioned therein, the free isocyanate group of urethane prepolymer is blocked with a bisulfite to prepare a hydrophilic and thermally reactive urethane, it is impregnated into a fiber product, and the fiber product is appropriately squeezed, preliminarily dried at 70°-100° C. for 3-5 minutes and thereafter heat-treated at 100°-180° C.

Contrariwise, the treating method of the present invention requires a mere drying at ordinary temperature, and no heat treatment is necessary there. The polyurethane used in the present invention may be any of water-soluble and/or water-dispersible polyurethanes having been prepared according to one of the processes mentioned in the referential examples of the present invention. Thus, it may be any of reactive polyurethanes and non-reactive polyurethanes.

Japanese Patent Examined Publication No. 62-38469 discloses a method for removing scale which comprises making an animal hair fiber adsorb a heavy metal catalyst and thereafter chlorinating it. Contrariwise, the treating method of the present invention utilizes no catalytic action and intends no removal of scale.

MEANS FOR SOLUTION OF THE PROBLEM

The treating agent of the present invention comprises, per 100 parts by weight of the total of ingredients a), b), c) and d):

ingredient a): a water-soluble and/or water-dispersible polyurethane in an amount of 5.0-100% by weight, preferably 20-100% by weight, most preferably 30-99% by weight, and particularly 50-97% by weight;

ingredient b): a salt of divalent to tetravalent metal in an amount of 0.0-20% by weight, preferably 0.2-15% by weight, most preferably 0.5-10% by weight, and particularly 1-5% by weight;

ingredient c): a nonionic, anionic or amphoteric surfactant in an amount of 0.0-40% by weight, preferably 0.2-30% by weight, most preferably 0.3-25% by weight and particularly 1-20% by weight; and ingredient d): auxiliary ingredient such as dispersant, crosslinking agent and the like in an amount of 0.0-40% by weight, preferably 0.0-20% by weight, most preferably 0.2-15% by weight and particularly 1-15% by weight.

If the amount of ingredient a) is smaller than 5% by weight, the properties and soft feeling of leather and fur are deteriorated and the flexibility, hand and shrink resistance of fibers are deteriorated.

If the amount of ingredient b), or the salt of divalent to tetravalent metal, exceeds 20% by weight, the ingredient b) becomes poor in dispersibility in the treating agent and is apt to precipitate, which is undesirable. If its amount is smaller than 0.1% by weight, its fixability on leather and fiber becomes worse.

If the amount of ingredient c), or the surfactant, exceeds 40% by weight, no particular improvement in effect is brought about by it. If its amount is smaller than 0.1% by weight, permeability is deteriorated and stability of this treating agent is also deteriorated.

The auxiliary ingredients d) are added for the purpose of improving the stability of the treating agent and improving the properties, dimensional stability, workability and marketability of the leather, fur and fibers having been treated with the treating agent. If the amount of ingredient d) exceeds 40% by weight, soft feeling is deteriorated.

The water-soluble and/or water-dispersible polyurethane constituting ingredient a) of the invention may be produced by any of the methods mentioned below. The polyurethanes thus prepared may be used singly and/or in combination of two or more members.

1. Water-soluble polyurethane (non-reactive type)

A polyurethane prepared by reacting a diisocyanate with a polyol containing a large quantity of ethylene oxide unit is water-soluble. For example, a polyurethane prepared by reacting polyethylene glycol with TDI is soluble in water.

2. Water-dispersible (emulsion) polyurethane (non-reactive, forced emulsification type)

This is a polyurethane solution prepared by reacting a polyol with a diisocyanate and dissolving the resulting polyurethane in an organic solvent. Otherwise, it is an emulsion prepared by reacting a polyol with a diisocyanate in an organic solvent, optionally diluting the resulting polyurethane solution with an organic solvent, and slowly adding the solution thus obtained into an aqueous solution of a surfactant to make a phase conversion and an emulsification take place.

As the emulsifier (surfactant), anionic surfactants (sodium alkylbenzenesulfonate and the like), cationic ones (quaternary ammonium salts and the like) and nonionic ones (ethylene oxide adducts of long chain alcohols and the like) are used. As the emulsion stabilizer, gelatine, sodium salt of carboxymethylcellulose, polyvinyl alcohol and the like are used.

3. Water-dispersion (emulsion) type polyurethane (non-reactive, self-emulsification type)

A prepolymer is prepared by carrying out a urethane forming reaction between a diisocyanate, a diol and a carboxyl-containing diol or a carboxyl-containing diamine. The prepolymer can be made into a self-emulsification type emulsion by the following two methods.

Thus, a tertiary amine compound such as N-alkyldialkanolamine or the like is used as a chain-lengthening agent at the time of preparing the prepolymer. The prepolymer thus formed is diluted with a solvent mentioned above and the part of tertiary amine is quaternarized (made hydrophilic) by the use of an aqueous solution of acid or a quaternarizing agent such as diethyl sulfate, methyl iodide or the like.

Otherwise, a quantity of free isocyanate group is left on the terminal of prepolymer molecule, and it is reacted with dimethylolpropionic acid or the like. Then, a basic aqueous solution is added thereto. Thus, an anionic polyurethane is formed. Since this polyurethane has hydrophilic groups in its molecule, it can be used as a water-dispersion type polyurethane which is characterized by requiring no use of a low molecular weight emulsifier which must be used in case of forced emulsification type.

5. Reactive type water-soluble or water-dispersible polyurethane (forced emulsification type, self-emulsification type)

When an isocyanate group is reacted with a specified active hydrogen-containing compound, it is temporarily combined with the latter, and the combined product liberates the original isocyanate when it is heated or pH is changed. Carbamoyl sulfonate formed by reacting an isocyanate and sodium bisulfite functions as a strong hydrophilic group, so that a polyurethane having such a group can be used as a water-soluble or water-dispersible polyurethane without using emulsifier.

As the water-soluble and/or water-dispersible polyurethane used as ingredient a) of the treating agent of the invention, the polyurethanes produced according to the above-mentioned methods 1 to 5 may be used either singly or in combination of two or more members. Among the polyurethanes 1–5, anionic ones, i.e. 1. water-soluble polyurethane (non-reactive type) and 3. water-dispersion (emulsion) type polyurethane (non-reactive, self-emulsification type) are preferably used.

Properties of these polyurethanes vary depending on molecular weight of the starting diol in the following manner.

1) Relation between 100% modulus and elongation

A diol having a high molecular weight gives a polyurethane having a low modulus and a great elongation, while a diol having a low molecular weight gives a polyurethane having a high modulus and a small elongation.

2) Reaction between hydrolysis resistance and ultraviolet resistance

Polyether type of polyurethanes are superior to polyester type of ones in hydrolysis resistance. Polyester type of ones are superior to polyether type of ones in ultraviolet resistance.

The polyurethane used in the present invention may be produced by any methods of 1–5, so far as the properties of the polyurethane produced is in the range specified in the following Table 1, and the polyurethanes produced by these methods can be put to respective uses in accordance with the purpose.

TABLE 1

| | | Use | | |
|---|---|---|---|---|
| Properties | Unit | Soft type for clothes | Semisoft type for clothes | Hard type for Industrial use |
| Hardness | | 10–40 | 40–60 | 60–75 |
| 100% modulus | $Kg/cm^2$ | 10–100 | 100–300 | 300–500 |
| Elongation | % | 300–1000 | 100–300 | 50–100 |

(Notes)
Hardness: Measured with Durometer type D prescribed in JIS-K-7215
100% modulus: Measured on No. 3 dampbell test piece (0.3 mm thickness) at 23° C. according to JIS (6301)
Elongation: Measured on No. 3 dampbell test piece (0.3 mm thickness) at 23° C. according to JIS (6301)

The diisocyanates which can be used in the production of water-soluble and/or water-dispersible polyurethanes used in the treating agent of the invention include aromatic diisocyanates such as tolylene diisocyanate (including 80:20 mixture of 2,4- and 2,6-isomers), 4,4-diphenylmethane diisocyanate (including crude, purified and modified products), m-phenylene diisocyanate, xylylene diisocyanate, naphthalene-1,5-diisocyanate, polymethylene-polyphenyl polyisocyanate, tolylene diisocyanate adduct of trimethylolpropane and the like, and aliphatic isocyanates such as tetramethylene diisocyanate, hexamethylene diisocyanate, 1,4-cyclohexylene diisocyanate, 4,4'-dicyclohexylmethane diisocyanate, isophorone diisocyanate, hydrogenated xylylene diisocyanate, tetramethylene diisocyanate and the like.

The diols which can be used in the production of the water-soluble and/or water-dispersible polyurethanes used as ingredient a) of the treating agent of the invention include polydiols such as polyether-diols (e.g. polyethylene glycol, polypropylene glycol, polytetramethylene glycol and the like), polyesters obtained by dehydrating condensation reaction between a polyhydric alcohol (e.g. ethylene glycol, propylene glycol, butanediol, hexanediol, neopentyl glycol, cyclohexyl-dimethanol and the like) and a polybasic carboxylic acid (e.g. maleic acid, suceinic acid, adipic acid, phthalic acid and the like); polyesters and polycarbonates obtained by a ring-opening polymerization of cyclic esters; low molecular weight glycols such as ethylene glycol, diethylene glycol, triethylene glycol, 1,2-propylene glycol, trimethylene glycol, 1,3-butylene glycol, tetramethylene glycol, hexamethylene glycol, hydrogenated Bishpenol A, ethylene oxide adduct and propylene oxide adduct of Bisphenol A and the like; diols having carboxyl group such as 2,2-dimethylolpropionic acid, 2,2-dimethylolbutyric acid, 2,2-dimethylolvaleric acid and the like; etc.

These diols preferably have a molecular weight of 200 to 15,000, more preferably 800 to 6,000. Examples of the starting alkylene oxide for these diols (polyalkylene-polyols) include ethylene oxide, propylene oxide, 1,2- and 2,3-butylene oxides, and mixtures of two or more members thereof. As the starting polyol of the polyalkylene-polyols, propylene glycol, ethylene glycol, dipropylene glycol, diethylene glycol, glycerin 1,4-butanediol, 1,6-hexanediol, glycerin triol, hexanetriol, trimethylolpropane, $C_8$–$C_{24}$ aliphatic triols, pentaerythritol, α-methylene-glucoside, tetramethylolmethane, sorbitol, xylitol, tetraol, $C_9$–$C_{24}$ aliphatic unsaturated polyhydric alcohols and the like can be referred to. As examples of the starting polyamine, ethylenediamine, γ-(methylamino)propylamine, diethylenetriamine, diaminopropane, alkyl-propanediamine, alkylpropylenediamine, hexamethylenediamine, tetramethylenediamine, bishexamethylenetriamine, triethylenetetramine, tetraethylenepentamine, pentaethylenehexamine, mono-, di- and triallylamines and the like can be referred to.

As the neutralizing agent, ammonia, trimethylamine, triethylamine, tripropylamine, tributylamine, triethanolamine, sodium hydroxide, potassium hydroxide and the like can be referred to.

As the chain-lengthening agent, ethylenediamine, propylenediamine, hexamethylenediamine, diethylenetriamine, triethylenetetramine and the like can be referred to.

As the agent used for making the polyurethane hydrophilic, sodium bisulfite and the like can be referred to.

As the acid diol, dimethylolpropionic acid and the like can be referred to.

As the acid diamine, diaminocarboxylic acid and the like can be referred to.

The salts of divalent to tetravalent metals constituting ingredient b) of the invention include inorganic acid salts and organic acid salts of such metals. As said metal, divalent metals such as copper, zinc, calcium, magnesium and the like, trivalent metals such as aluminum, chromium, iron, lanthanum, cerium and the like, and tetravalent metals such as zirconium, silicon and the like can be referred to.

Examples of the aluminum salt include sodium aluminate, aluminum sulfate, aluminum ammonium sulfate, potassium aluminum sulfate, aluminum nitrate, aluminum acetate, aluminum fluoride, aluminum chloride, aluminum oxalate, aluminum lactate and the like.

Examples of the zirconium salt include zirconium sulfate and the like. Examples of the chromium salt include chromium sulfate and the like. Among the salts mentioned above, aluminum salts such as sodium aluminate, aluminum sulfate and the like are more preferred. These salts may be used in combination with other metallic salts.

Examples of the nonionic surfactant used as the surfactant of ingredient c) include the following:

1. polyoxyethylene alkylphenyl ethers having an alkyl group of which mean carbon number is 6–12 and having 1–20 mol of ethylene oxide unit, polyoxypropylene alkyl ether, polyoxyethylene polyoxypropylene alkyl ether, higher fatty acid alkanolamide and its ethylene oxide adduct, sucrose fatty acid ester, alkylsaccharoid, and fatty acid monoester of glycerin;
2. polyoxyethylene alkyl or alkenyl ethers having an alkyl or alkenyl group of which mean carbon number is 10–20 and having 1–20 mol of ethylene oxide unit; and the like.

Examples of the anionic surfactant include the following:

b 1. alkali metal salts of higher fatty acids (soaps);
2. alkyl or alkenyl sulfates having a straight chain or branched chain alkyl or alkenyl group of which mean carbon number is 10–20 and having 0.5–8, on the average, ethylene oxide unit per molecule;
3. alkylbenzenesulfonic acid salts having an alkyl group of which mean carbon number is 10–16;
4. alkyl or alkenyl sulfate salts having an alkyl or alkenyl group of which mean carbon number is 10–20;
5. olefinsulfonic acid salts having 10–20 carbon atoms per molecule on the average;
6. alkanesulfonic acid salts having 10–20 carbon atoms per molecule on the average;
7. sodium sulfosuccinate;
8. salts of ether-carboxylic acid;
9. sodium acyl-N-methyltaurate-sulfonate;
10. sodium sarcosinate;
11. N-acylglutamate;
12. alkyl ether sulfate;
13. alkyl polyglucoside;
14. monoalkyl phosphate;
15. fatty acid alkanolamide;
16. higher alcohol ethoxylate;
17. higher alcohol sulfate; and the like.

Examples of the amphoteric surfactant include the following:

1. alkylbetaine type amphoteric surfactants;
2. amidobetaine type amphoteric surfactants; and the like.

Each of the above-mentioned nonionic, anionic and amphoteric surfactants may be used in the form of a mixture of two or members belonging to one type and/or in combination of two or more types.

As the auxiliary ingredients (d), microbicide, perfume, colorant, viscosity-fluidity regulator, pH regulator, whitening agent, solubilizer, stability improver, crosslinking property improver, dispersibility improver, fixability improver and the like are appropriately added. As a main auxiliary ingredient, a compound having epoxy group or alkoxymethyl group can be used. Examples of such a compound include polyethylene glycol diepoxide, Bisphenol A diglycidyl ether, crosslinking agent CR-5L (manufactured by Dainippon Ink Kagaku), hexamethoxymethylmelamine, oil-soluble melamine resin, methoxymethylolurea and the like. Preferably, low temperature crosslinking water-soluble epoxy resin and water-soluble alkylated methylolmelamine resin are used.

The auxiliary ingredient used in the treating agent of the invention can contain the diols mentioned above, imidazoles and aromatic compounds preferably once, twice or three times substituted by amino group, halogen or sulfon group. Examples of such aromatic compound include aniline, 2,4-diaminotoluene, 2,6-diaminotoluene, p-phenylenediamine, o-phenylenediamine, m-phenylenediamine, o-toluylenediamine, m-toluylenediamine, p-toluylenediamine, o-chloroaniline, m-chloroaniline, p-chloroaniline, o-dichlorobenzene, trichlorobenzene, monochlorobenzene, o-dibromobenzene, p-aminophenol, m-aminophenol, o-aminophenol, p-hydroxyphenylglycine, benzene-p-disulfonic acid, benzene-monosulfonic acid and the like. Among the aromatic compounds mentioned above, amino-substituted and halo-substituted benzenes are preferable, and aniline is particularly preferable.

As the solubilizing agent, lower alcohols such as ethanol, isopropyl alcohol and the like, benzenesulfonic acid salts, lower alkylbenzenesulfonic acid salts, polyethylene glycol, polypropylene glycol, polyoxyethylene-polyoxypropylene glycol, acetamides, pyridinecarboxylic acid amides benzoic acid salts, urea, and the like can be referred to.

The dispersion stabilizer includes aluminum chelate compounds such as aluminum ethyl acetoacetate diisopropylate and the like; aluminum type and titanium type couplers; silane couplers; trisodium phosphate, disodium hydrogen phosphate, tetrasodium pyrophosphate, sodium tripolyphosphate, tripotassium phosphate, dipotassium phosphate, tetrapotassium pyrophosphate, potassium hexametaphosphate, sodium hexametaphosphate, sodium orthosilicate, sodium sesquisilicate, sodium metasilicate, collidal sodium silicate containing a large quantity of $SiO_2$, sodium sulfate, sodium perborate, sodium carbonate, sodium hydrogen carbonate, sodium sesquicarbonate and the like. As organic builders, salts of citric acid, malonic acid, succinic acid, malic acid, diglycolic acid, tartaric acid and the like, salts of nitrotriacetic acid, salts of aminopolyacetic acids such as ethylenediamine-tetraacetic acid and the like, salts of carboxymethyl-tartronic acid, salts of carboxymethyloxy-succinic acid, oligomers of acrylic acid salts and hydroxyacrylic acid salts, poly(meth)acrylic acid salts, polymaleic acid salts, and salts of polymeric compounds such as (meth)acrylic acid-acrylic ester copolymer, maleic anhydride-diisobutylene copolymer, maleic anhydridemethyl vinyl ether copolymer, maleic anhydride-(meth)acrylic ester copolymer and the like. Soluble organic complex compounds including $Al^{+}$, $Ca^{30}$, $Mg^+$ and the like are preferred, and polycarboxylate compounds are particularly preferred.

WORKING EXAMPLES

Method for Preparing the Agent of the Invention for Treating Leather, Fur and Fibers The treating agents of the invention were prepared by using each of the water-soluble and/or water-dispersible polyurethanes prepared according to Referential Examples 1–6 mentioned later as ingredient a) and adding thereto a salt of divalent to tetravalent metal of ingredient b), a surfactant of ingredient c) and auxiliary ingredients of d) in varied kind and amount. The results of the treatment of leather, fur and fibers using the treating agent of the invention are shown in Tables 2 and 3.

A concrete method of the preparation is mentioned below.

In a reactor equipped with a reflux condenser, a thermometer and a stirrer, 100 parts of a water-soluble polyurethane and/or a water-dispersible polyurethane produced according to each of Referential Examples 1–6 was added as ingredient a) and stirred. In another vessel, a solution having a controlled pH value of 6–9 was prepared from a 10% aqueous solution of the divalent to tetravalent metal salt of ingredient b) and a neutralizing agent of ingredient d) (polyacrylic acid and/or sodium polyacrylate type dispersant, ammonia, sodium hydroxide, potassium hydroxide or the like). A necessary quantity (150 parts or less) of the latter was slowly added to the first solution. After adding its whole quantity, the resulting mixture was stirred at a high speed for 5 minutes at 70°–80° C. The total period of time of the stirring was 2 hours, as measured from the start of its addition. Then, a necessary quantity (40 parts or less) of the surfactant (nonionic, anionic or amphoteric) of ingredient c) was added, and the resulting mixture was stirred for 15 minutes. Then, a necessary quantity (40 parts or less) of the auxiliary ingredient d) was added and the resulting mixture was stirred for one hour. Then, the whole mixture was cooled to room temperature to obtain a treating agent of the invention.

pH value of the treating agent of the invention is 3.5–9.0, preferably 4.5–8.5, and most preferably 5.5–8.0.

REFERENTIAL EXAMPLE 1 (NON-REACTIVE TYPE)

In a reactor equipped with a reflux condenser, a thermometer and a stirrer, 900 parts of polyoxyethylene-polyoxypropylene polyol (Sannix FA, manufactured by Sanyo Kasei Kogyo), 40 parts of 4,4'-diphenylmethane diisocyanate and 2 parts of nitrogen-containing polyoxyethylene nonylphenyl ether (Sannix CA, manufactured by Sanyo Kasei Kogyo) as a catalyst were charged and reacted with stirring at 70°–80° C. for 3 hours. Then, 600 parts of hot water having a temperature of 40° C. was added to prepare a water-soluble polyurethane.

REFERENTIAL EXAMPLE 2 WATER-DISPERSIBLE (EMULSION) TYPE POLYURETHANE (NON-REACTIVE, FORCED EMULSIFICATION TYPE)

In a reactor equipped with a reflux condenser, a thermometer and a stirrer, 240 parts of a polyesterglycol (molecular weight 1,000) prepared by dehydrating condensation of equimolar quantities of ethylene glycol, 1,6-hexanediol and adipic acid was dissolved in 120 parts of toluene, to which were added 42 parts of a 80:20 mixture of 2,4-tolylene diisocyanate and 2,6-tolylene diisocyanate and 0.1 part of dibutyltin laurate as a catalyst. At 75°–85° C., a urethane-forming reaction was carried our for 2 hours to prepare a prepolymer. Then, a solution prepared by adding 10 parts of polyoxyethylene nonylphenyl ether as an emulsifier (surfactant) and 30 parts of hexamethylenediamine as a crosslinking agent into 550 parts of hot water was added with a high speed stirring, after which the toluene was distilled off under reduced pressure to obtain a water-dispersible emulsion of polyurethane.

REFERENTIAL EXAMPLE 3 WATER-DISPERSIBLE (EMULSION) POLYURETHANE (NON-REACTIVE, SELF-EMULSIFICATION TYPE)=ANIONIC TYPE

In a reactor equipped with a reflux condenser, a thermometer and a stirrer, 250 parts of polytetramethylene glycol (molecular weight 1,000), 125 parts of isophorone diisocyanate, 25 parts of dimethylolpropionic acid and 110 parts of methyl ethyl ketone were subjected to a urethane-forming reaction at 75°–85° C. for 4 hours to prepare a prepolymer. After neutralizing it with 18 parts of triethylamine, 585 parts of distilled water containing 5 parts of diethylenetriamine was added, and the methyl ethyl ketone was distilled off under reduced pressure to prepare an aqueous solution of polyurethane.

REFERENTIAL EXAMPLE 4 WATER-DISPERSIBLE (EMULSION) POLYURETHANE (NON-REACTIVE, SELF-EMULSIFICATION TYPE)=CATIONIC TYPE

A propylene oxide adduct of Bisphenol A (hydroxyl value 315) was heated at 100° C. and dehydrated under reduced pressure. Its 115 parts was introduced into a reactor equipped with a reflux condenser, a thermometer and a stirrer. After adding 100 parts of methyl ethyl ketone and 115 parts of a 80:20 mixture of 2,4-tolylene diisocyanate and 2,6-tolylene diisocyanate thereto, the resulting mixture was reacted at 70° C. for 4 hours to obtain a solution of a urethane prepolymer having 8.4% of free diisocyanate group.

On the other hand, 490 parts of methyl ethyl ketone and 40 parts of diethylenetriamine were introduced into another flask and mixed together at 30°–40° C. Into the solution thus obtained was slowly added 300 parts of the above-mentioned urethane prepolymer solution with stirring over a period of 40 minutes. Then, it was diluted with 160 parts of methyl ethyl ketone and reacted at 50° C. for 30 minutes. Then, 100 parts of water and 18 parts of epichlorohydrin were added to the reaction mixture and reacted at 50° C. for one hour. After adding 43 parts of 70% aqueous solution of glycolic acid and 700 parts of water, the methyl ethyl ketone was distilled off under reduced pressure to obtain a stable polyurethane emulsion having a resin content of 30%.

REFERENTIAL EXAMPLE 5 REACTIVE WATER-SOLUBLE POLYURETHANE (SELF-EMULSIFICATION TYPE)

To 110 parts of a nonionic surfactant (average molecular weight 450) prepared by adding 5 mol of ethylene oxide to nonylphenol was added 42 parts of hexamethylene diisocyanate. The mixture was reacted at 85°-90° C. for one hour to obtain a urethane prepolymer having a free isocyanate group content of 6.8. The prepolymer was cooled to 50° C., its viscosity was regulated by adding 30 parts of dioxane, and then 74 parts of 35% aqueous solution of sodium bisulfite was added and stirred. The mixture was reacted for 20 minutes to obtain a viscous liquid. By adding 100 parts of water thereto, an aqueous solution of an anionic reactive type polyurethane was obtained.

REFERENTIAL EXAMPLE 6 REACTIVE WATER-DISPERSIBLE (EMULSION) TYPE POLYURETHANE (FORCE EMULSIFICATION TYPE)

Under a stream of nitrogen gas, 21 parts of a block copolymer type polyether-diol (OHV 46.7) having an average molecular weight of 2,400 prepared by adding ethylene oxide to polypropylene glycol having an average molecular weight of 1,200, 56 parts of an adipic acid-1,6-hexanediol-neopentyl glycol type (molar ratio 10:7:4) polyester-diol (OHV 45.1, AV 2.4), 3 parts of 1,6-hexanediol and 20 parts of hexamethylene diisocyanate were reacted at 100°-105° C. for one hour. The NCO/OH ratio was 2.05, the found value of free NCO content was 5.01% (calculated value 5.13%), and the content of oxyethylene chain in the prepolymer was 10.1%. The prepolymer thus obtained was cooled to 40° C., its viscosity was regulated by adding 20 parts of dioxane, and then 65 parts of 25% aqueous solution of sodium bisulfite was added thereto at 40° C. and the resulting mixture was thoroughly stirred. The mixture formed a uniform water-in-oil type emulsion of high viscosity in about 5 minutes. When the stirring was continued for 15 minutes, the viscosity rapidly decreased. By adding 200 parts of water thereto, there was obtained a completely oil-in-water type emulsion having a solid content of about 30%.

METHOD FOR TREATING LEATHER AND FUR

The raw leather to be treated with the treating agent of the invention is not critical, but raw skin, pelt, pickled pelt, tanned leather, dyed leather, fatted leather and the like are successfully treated, among which raw skin, pelt and pickled skin are more successfully treated and raw skin is particularly successfully treated. The method of the present invention using the treating agent of the invention is carried out in the following manner. Thus, in case of raw skin, in the process of liming which is carried out after soaking and fleshing, the treating agent of the invention is added in an amount of 1.0-25.0% by weight based on the weight of dry skin in a milk of slaked lime, and the treatment is carried out simultaneously with the liming. In case of pelt, pickled pelt, tanned leather, dyed leather and fatted leather, the treating agent of the invention is added in an amount of 1.0-15.0% by weight based on the weight of dry skin. In both these cases, the treating agent of the invention is diluted with about 5 to 100 times its quantity of water and then put to use for the sake of facilitating the treatment. The raw skins to which the treatment of the invention can be applied are those used in the tanning industry, which include cattle skin (cattle group), sheep skin (sheep group), goat skin (goat group), equine skin (equine group), pig skin (pig group), deer skin (deer group), kangaroo skin (kangaroo group), skins of aquatic animals (aquatic animal group) and the like and their furs. Among them, cattle skin, sheep skin, goat skin and pig skin are preferable.

EFFECT OF THE INVENTION

The treating agent of the present invention makes it possible to treat raw skin, pelt, pickled pelt, tanned leather, dyed leather, fatted leather and the like by the simple procedures mentioned above. By this time, the water absorption into the reticular layer of leather can be enhanced and extensibility is also improved. Even after repeated washing in water, no hardening takes place, flexibility can be kept unchanged, and a high dimensional stability is exhibited. A leather having been washed in water, containing a large quantity of water, does not harden even if it is dried in exposure to direct sunlight. The treated product can be sewn by means of domestic sewing machines similarly to usual cloths.

Further, a leather which has been treated according to the invention is increased in area, so that the yield of leather product is improved by about 10% on the average. In addition, the product treated is improved in tensile strength and tear strength and excellent in flexibility and hand. It is not slippy and undergoes no thinning. It is heat-resistant, can be ironed at low temperature and is small in loss of short fiber due to fiber breakage. Metallic powder such as finely powdered copper and the like can easily be adsorbed in the texture of leather and it is not lost upon washing in water. It is useful as a binder for microbicide, deodorant, perfume, colorant and the like.

A leather having been treated with the treating agent of the invention has the above-mentioned merits, owing to which it is widely usable as clothings, underwares, helmet leather, back skin and gloves, as well as squeeze-formed articles made from single leather sheet such as shoes, trunk, bag, box, hat, slipper, socks cover and the like, leather paper excellent in dimensional precision and flexural resistance, leather paper prepared by unbinding a leather into a fibrous material and making it into a paper, and unwoven fabric, mat-form article and leather cloth prepared by bonding the fibrous material with a binder.

The treating agent of the invention is further useful as a treating agent for natural fibrous materials such as wood, cotton, flax, wool, silk, and the like, their mixed yarn woven, knit and unwoven fabrics with synthetic fibers, and artificial leathers. In this use, the treating agent of the invention exhibits excellent performances that it gives a low shrinkage percentage without affecting the hand.

Next, the present invention will be illustrated in more detail by way of the following referential examples and examples, wherein all the quantities are in terms of weight, unless otherwise specified.

TREATMENT OF RAW SKIN

Thirty eight liters of a saturated lime milk (pH 12.5) was introduced into a testing tanning machine, and 560 g of the treating agent prepared in Example 1 was added and stirred to prepare a uniform fluid. Then, 2.3 kg (expressed by the weight of dry skin) of a raw skin (flesh pig skin) was dipped in the fluid, the liquid temperature was adjusted to 35° C. or below, stirring was continued for one hour, and then the skin was taken out. It was washed in running water for 30 minutes. Then, 38 liters of water and a quantity of lactic acid were added to adjust pH to 4. Then, the skin having been treated above was again dipped in the fluid and stirred for one hour. Then, it was washed in running water for 30 minutes, dehydrated, and dehaired in the usual manner. Then, it was delimed with an acid in the usual manner. Then, it was subjected to reliming treatment, enzymic treatment, aluminum sulfate treatment, chrome tanning in the usual manner (chrome quantity 6% based on the weight of pelt, chrome adsorption about 90% or more), washing in water, and neutralization, dyeing, fatting and toggle-drying in the usual manner to obtain a product leather. By a post-splitting, it was made into a clothing leather having a thickness of 0.7 mm.

Properties of the leather thus treated are shown in Table 2, Example 10. In Comparative Example 10, a leather was treated in the same manner as in Example 10, except that water was used in place of the treating agent of the invention.

The surfactant used in the treating agent of the invention was a nonionic surfactant of which ethylene oxide addition number was 8 on the average. Preparation of Test Leather In the usual manner, a raw skin (flesh skins of cattle, sheep and pig) was successively subjected to washing in water, defatting, washing in water, dehairing, liming, deliming, washing in water, pickling, chrome tanning (chrome quantity 5% based on the weight of pelt), neutralization, washing in water and hanging drying to prepare a wet blue, and it was used as a test leather.

The test leather was cut into two equal parts from the head to the tail. One piece of them was used in a test using the treating agent of the invention, while another piece was used in a comparative example. In order to avoid the difference between regions (shoulder, trunk, abdomen and buttocks), nearly the same regions were used in the example and the comparative example. Method for Leather Treatment in Examples of the Invention A treating solution was prepared by mixing 4% by weight (based on the dry weight of leather wet blue to be tested) with 70 times the leather weight of water, and stirring the mixture. A leather to be tested was thrown into the treating solution and subjected to a dipping treatment for 6 hours, during which a rotation for 15 minutes was followed by a pause for 45 minutes and this cycle was repeated. In the steps after picking, the treating agent of the invention was used usually in an amount of 0.3–15% based on the dry weight of leather.

When the dipping treatment was completed, the water was discharged, and 70 times by weight of fresh water and 0.05 time by weigh of benzalkonium chloride, both based on the weight of leather, were added. After rotation for 15 minutes, they were discharged. Then, the leather was rinsed in running water for 30 minutes and dehydrated, after which the leather fiber was crumpled in the usual manner to prepare a product leather, and it was used as a test leather.

METHOD FOR LEATHER TREATMENT IN COMPARATIVE EXAMPLE 1

A wet blue prepared in the above-mentioned manner was treated and crumpled in the same manner as in Example 1 and used as a test leather. Its properties were measured in the same manner as in Example 1.

The properties of the leathers thus treated are shown in Table 2.

EXAMPLES 2–9 AND EXAMPLES 11–27

The same test piece as in Example 1 was treated under the same conditions as in Example 1, except that the formulation of the treating composition was altered as shown in Tables 2 and 3.

COMPARATIVE EXAMPLES 2–9 AND COMPARATIVE EXAMPLES 11–27

Treatment and measurement of properties were carried out in the same manner as in Comparative Example 1. Properties of the leathers thus treated are shown in Tables 2 and 3.

Method of washing: Washing was carried out according to JIS-L-0217-1976-No. 103. Thirty liters of water having a temperature of 40° C. was introduced into the water tank of a domestic electric washing machine having a standard washing capacity and a standard water quantity equipped with a centrifugal squeezing apparatus conforming to the standard of JIS-C-9606 (Electrical Washing Machine), and a synthetic detergent for clothing (manufactured by Kao) was added and dissolved in the water at a proportion of 2 grams per liter water. A sample and, if necessary, a loading cloth were thrown into the water so as to give a bath ratio of 1:30, and the washing machine was started to work. After treatment for 5 minutes, the machine was stopped, and the sample and loading cloth were dehydrated by the dehydrater. Then, the washing solution was replaced with fresh water of ordinary temperature, and rinsing with water was carried out for 2 minutes at the same bath ratio as above. After twice repeating the washing, the sample was dehydrated and hanging-dried.

Washing resistance in water: A leather sample was repeatedly washed by the procedure mentioned above, and the number of washing required for reaching a noticeable loss in flexibility and hard touch was determined, by which the washing resistance was expressed.

Tensile strength: It was measured according to JIS-K-6552-1977, Testing Method for Clothing Leather.

Elongation: It was measured according to JIS-K-6552-1977, Testing Method for Clothing Leather.

Tear strength: It was measured according to JIS-K-6552-1977, Testing Method for Clothing Leather.

Water absorption: It was measured according to JIS-K-6550-1976, Testing Method for Leather.

Moisture absorption rate ($mg/cm^2/72$ hr): It was measured according to JIS-K-6544.

Quantity of moisture absorbed ($mg/cm^2$): It was measured by allowing a sample to stand at 20° C.×RH52% for 72 hours and then weighing it at RH79%.

Loss in moisture ($mg/cm^2$): It was determined by allowing a sample to stand at 20° C.×RH79% for 72 hours and then weighing it at RH52%.

Dimensional stability after washing: A leather sample having a size of 15 cm×15 cm was three times washed, after which the change in dimension was calculated according to the following equation:

$$\text{Dimensional change rate (\%)} = \frac{L - L'}{L} \times 100$$

wherein L=value before washing, L'=value after washing, and Δ denotes elongation.

Permeation-dispersion property of leather fiber into water: A leather sample was pulverized and disintegrated with a pulverizer into a size of 1–3 mm. While slowly stirring 150 cc of water in a 300 cc beaker at 30 rpm with a magnetic stirrer, 3 grams of the pulverized leather obtained above was thrown onto the upper surface of the water. Permeation-dispersion property of the sample was expressed by the period of time required for completely sinking the leather sample into the water.

Area increase rate: The change in area of lather sample (wet blue) brought about by a treating agent is expressed by the following formula:

$$\text{Area increase rate (\%)} = \frac{M'\text{cm}^2 - M\text{cm}^2}{M\text{cm}^2} \times 100$$

wherein M = area before treatment ($cm^2$), and M' = area after treatment ($cm^2$), provided that a negative value means a shrinkage.

In the comparative examples, the treatment was carried out under the same conditions as in the examples of the invention, except that the treating agent was replaced with water only.

TABLE 2

| | Ex-1 | C. Ex-1 | Ex-2 | C. Ex-2 | Ex-3 | C. Ex-3 |
|---|---|---|---|---|---|---|
| a) Component: aqueous urethane | | | | | | |
| (parts) | 90 | — | 25 | — | 98 | — |
| (polyurethane used) | Ref. Ex-1 | | Ref. Ex-1 | | Ref. Ex-1 | |
| b) Component: polyvalent metal salt | | | | | | |
| (parts) | 2.5 | — | 5 | — | 0.5 | — |
| (used salt) | Aluminum sulfate | | Aluminum sulfate Zirconium sulfate | | Aluminum sulfate | |
| c) Component: surfactant | | | | | | |
| (parts) | 7.5 | — | 30 | — | 1.5 | — |
| (kind of emulsifier) | Nonionic | | Nonionic + Anionic | | Nonionic | |
| d) Component: auxiliary component | | | | | | |
| (parts) | 2 | — | 40 | — | 0 | — |
| (kind) | Acrylic dispersant | | * | | | |
| Treated leather | Pig | Pig | Pig | Pig | Pig | Pig |
| Thickness of test leather (mm) | 0.6 | 0.6 | 0.6 | 0.6 | 0.6 | 0.6 |
| Basis elongation (%)*1 | 23.5 | 2.0 | 26.0 | 2.4 | 18.5 | 2.5 |
| Tensile strength (kgf) | 5 | 4 | 4 | 4 | 3.5 | 4 |
| Elongation (%) | 32 | 36 | 30 | 35 | 30 | 36 |
| Tear strength (kgf/mm) | 1.9 | 1.5 | 1.7 | 1.5 | 2.0 | 1.5 |
| Water absorption (30 min) (%) | 285 | 199 | 250 | 191 | 200 | 195 |
| Water-dispersibility of leather fiber (min) | 0.1 | <120 | 10 | <120 | 5 | <120 |
| Washing resistance (time) | <10 | 3 | <5 | 3 | <10 | 3 |
| Dimensional stability after washing ( : elongation; no mark: shrinkage) | 1.3 × 2.0 | 3.7 × 5.7 | 1.0 × 2.2 | 3.5 × 6.0 | 2.0 × 2.7 | 3.7 × 5.7 |

| | Ex-4 | C. Ex-4 | Ex-5 | C. Ex-5 | Ex-6 | C. Ex-6 |
|---|---|---|---|---|---|---|
| a) Component: aqueous urethane | | | | | | |
| (parts) | 90 | — | 25 | — | 98 | — |
| (polyurethane used) | Ref. Ex-3 | | Ref. Ex-3 | | Ref. Ex-3 | |
| b) Component: polyvalent metal salt | | | | | | |
| (parts) | 2.5 | — | 5 | — | 0.5 | — |
| (used salt) | Sodium aluminate | | Sodium aluminate + zirconium sulfate | | Sodium aluminate | |
| c) Component: surfactant | | | | | | |
| (parts) | 7.5 | — | 30 | — | 1.5 | — |
| (kind of emulsifier) | Nonionic | | Nonionic | | Nonionic | |
| d) Component: auxiliary component | | | | | | |
| (parts) | 2 | — | 40 | — | 0 | — |
| (kind) | Acrylic dispersant | | * | | | |
| Treated leather | Cattle | Cattle | Cattle | Cattle | Cattle | Cattle |
| Thickness of test leather (mm) | 3.0 | 4.0 | 3.0 | 4.0 | 3.0 | 4.0 |
| Basis elongation (%)*1 | 1.5 | 1.5 | 3.0 | 1.5 | 1.3 | 1.5 |
| Tensile strength (kgf) | 2.5 $kgf/mm^2$ | 2.3 $kgf/mm^2$ | 2.2 $kgf/mm^2$ | 2.3 $kgf/mm^2$ | 1.9 $kgf/mm^2$ | 2.3 $kgf/mm^2$ |
| Elongation (%) | 45 | 47 | 47 | 47 | 50 | 47 |
| Tear strength (kgf/mm) | 4.6 | 6.0 | 4.1 | 5.8 | 4.3 | 6.0 |
| Water absorption (30 min) (%) | 80 | 40 | 60 | 41 | 85 | 39 |
| Water-dispersibility of leather fiber (min) | 0.1 | <120 | 10 | <120 | 5 | <120 |

TABLE 2-continued

| | | | | | | |
|---|---|---|---|---|---|---|
| Washing resistance (time) | <10 | 2 | <5 | 2 | <10 | 2 |
| Dimensional stability after washing ( : elongation; no mark: shrinkage) | 0.7 × 0.4 | 0.7 × 0.4 | 0.2 × 0.1 | 0.7 × 0.3 | 0.7 × 0.4 | 0.7 × 0.4 |

| | Ex-7 | C. Ex-7 | Ex-8 | C. Ex-8 | Ex-9 | C. Ex-9 |
|---|---|---|---|---|---|---|
| a) Component: aqueous urethane | | | | | | |
| (parts) | 90 | — | 25 | — | 98 | — |
| (polyurethane used) | Ref. Ex-3 | | Ref. Ex-3 | | Ref. Ex-3 | |
| b) Component: polyvalent metal salt | | | | | | |
| (parts) | 2.5 | — | 5 | — | 0.5 | — |
| (used salt) | Sodium aluminate | | Sodium aluminate + zirconium sulfate | | Sodium aluminate | |
| c) Component: surfactant | | | | | | |
| (parts) | 7.5 | — | 30 | — | 1.5 | — |
| (kind of emulsifier) | Nonionic | | Nonionic + anionic | | Nonionic | |
| d) Component: auxiliary component | | | | | | |
| (parts) | 2 | — | 40 | — | 0 | — |
| (kind) | Acrylic dispersant | | * | | | |
| Treated leather | Sheep | Sheep | Sheep | Sheep | Sheep | Sheep |
| Thickness of test leather (mm) | 0.8 | 0.8 | 0.8 | 0.8 | 0.8 | 0.8 |
| Basis elongation (%)*1 | 3.0 | 6.1 | 4.0 | 7.6 | 2.7 | 8.7 |
| Tensile strength (kgf) | 4.5 | 4 | 4 | 4 | 4.5 | 4 |
| Elongation (%) | 50 | 54 | 56 | 54 | 52 | 54 |
| Tear strength (kgf/mm) | 1.1 | 0.7 | 0.8 | 0.7 | 0.9 | 0.7 |
| Water absorption (30 min) (%) | 272 | 200 | 250 | 206 | 213 | 206 |
| Water-dispersibility of leather fiber (min) | 0.1 | <120 | 10 | <120 | 5 | <120 |
| Washing resistance (time) | <10 | 3 | <5 | 3 | <10 | 3 |
| Dimensional stability after washing ( : elongation; no mark: shrinkage) | 0.9 × 0.7 | 8.7 × 0.7 | 1.2 × 1.0 | 8.7 × 1.4 | 0.7 × 0.7 | 8.7 × 1.3 |

| | Ex-10 | C. Ex-10 | Ex-11 | C. Ex-11 | Ex-12 | C. Ex-12 |
|---|---|---|---|---|---|---|
| a) Component: aqueous urethane | | | | | | |
| (parts) | 90 | — | 80 | — | 80 | — |
| (polyurethane used) | Ref. Ex-1 | | Ref. Ex-3 | | Ref. Ex-3 | |
| b) Component: polyvalent metal salt | | | | | | |
| (parts) | 2.5 | — | 3 | — | 0 | — |
| (used salt) | Aluminum sulfate | | Sodium aluminate | | | |
| c) Component: surfactant | | | | | | |
| (parts) | 7.5 | — | 8 | — | 11 | — |
| (kind of emulsifier) | Nonionic | | Nonionic | | Nonionic | |
| d) Component: auxiliary component | | | | | | |
| (parts) | 2 | — | 9 | — | 9 | — |
| (kind) | Acrylic dispersant | | Acrylic dispersant | | Acrylic dispersant | |
| Treated leather | Pig | Pig | Pig | Pig | Pig | Pig |
| Thickness of test leather (mm) | 0.7 | 0.7 | 0.5 | 0.6 | 0.5 | 0.6 |
| Basis elongation (%)*1 | 23.0 | 2.5 | 9.8 | 3.5 | 6.0 | 4.6 |
| Tensile strength (kgf) | 9 | 8 | 6 | 3 | 3.5 | 3 |
| Elongation (%) | 35 | 35 | 37 | 48 | 40 | 46 |
| Tear strength (kgf/mm) | 1.3 | 1.3 | 1.1 | 1.0 | 1.2 | 1.0 |
| Water absorption (30 min) (%) | 260 | 190 | 170 | 150 | 165 | 150 |
| Water-dispersibility of leather fiber (min) | 0.1 | <120 | 0.1 | <120 | 0.1 | <120 |
| Washing resistance (time) | <10 | 3 | <5 | 3 | <5 | 3 |
| Dimensional stability after washing ( : elongation; no mark: shrinkage) | 1.0 × 2.0 | 3.5 × 6.5 | 1.0 × 1.3 | 4.0 × 6.2 | 1.0 × 1.8 | 3.5 × 6.3 |

| | Ex-13 | C. Ex. 13 | Ex-14 | C. Ex-14 | Ex.-15 | C. Ex-15 |
|---|---|---|---|---|---|---|
| a) Component: aqueous urethane | | | | | | |
| (parts) | 99.8 | — | 20 | — | 98 | — |

TABLE 2-continued

| | | | | | | |
|---|---|---|---|---|---|---|
| (polyurethane used) | Ref. Ex-3 | | Ref. Ex-3 | | Ref. Ex-3 | |
| b) Component: polyvalent metal salt | | | | | | |
| (parts) | 0 | — | 5 | — | 0.5 | — |
| (used salt) | | | Sodium aluminate + aluminum sulfate | | Sodium aluminate | |
| c) Component: surfactant | | | | | | |
| (parts) | 0.2 | — | 35 | — | 0.5 | — |
| (kind of emulsifier) | Nonionic | | Nonionic + anionic | | Nonionic | |
| d) Component: auxiliary component | | | | | | |
| (parts) | 0 | — | 40 | — | 1.0 | — |
| (kind) | | * | | Acrylic dispersant | | |
| Treated leather | Pig | Pig | Pig | Pig | Pig | Pig |
| Thickness of test leather (mm) | 0.5 | 0.6 | 0.6 | 0.6 | 0.7 | 0.7 |
| Basis elongation (%)*1 | 1.0 | 7.4 | 18.0 | 7.0 | 4.0 | 7.5 |
| Tensile strength (kgf) | 5 | 3 | 3 | 3 | 6 | 8 |
| Elongation (%) | 35 | 48 | 40 | 47 | 39 | 44 |
| Tear strength (kgf/mm) | 1.4 | 1.0 | 1.2 | 1.0 | 1.5 | 1.1 |
| Water absorption (30 min) (%) | 130 | 151 | 162 | 152 | 135 | 150 |
| Water-dispersibility of leather fiber (min) | 10 | <120 | 10 | 120 | 5 | 120 |
| Washing resistance (time) | <5 | 3 | <5 | 3 | <10 | 2 |
| Dimensional stability after washing ( : elongation; no mark: shrinkage) | 0.5 × 1.0 | 3.2 × 6.0 | 1.0 × 1.0 | 4.0 × 5.8 | 0.5 × 1.0 | 2.8 × 6.3 |

| | Ex-16 | C. Ex-16 | Ex-17 | C. Ex-17 | Ex.-18 | C. Ex-18 |
|---|---|---|---|---|---|---|
| a) Component: aqueous urethane | | | | | | |
| (parts) | 70 | — | 55 | — | 55 | — |
| (polyurethane used) | Ref. Ex-3 | | Ref. Ex-3 | | Ref. Ex-3 | |
| b) Component: polyvalent metal salt | | | | | | |
| (parts) | 12 | — | 3 | — | 3 | — |
| (used salt) | Sodium aluminate + zirconium sulfate | | Sodium aluminate | | Chromium sulfate + copper sulfate | |
| c) Component: surfactant | | | | | | |
| (parts) | 9 | — | 40 | — | 40 | — |
| (kind of emulsifier) | Nonionic | | Nonionic + anionic + amphoteric | | Nonionic + anionic + amphoteric | |
| d) Component: auxiliary component | | | | | | |
| (parts) | 9 | — | 2 | — | 2 | — |
| (kind) | Acrylic dispersant | | Acrylic dispersant | | Acrylic dispersant | |
| Treated leather | Pig | Pig | Pig | Pig | Pig | Pig |
| Thickness of test leather (mm) | 0.6 | 0.6 | 0.6 | 0.6 | 0.6 | 0.6 |
| Basis elongation (%)*1 | 5.3 | 6.0 | 6.0 | 6.2 | 6.5 | 5.0 |
| Tensile strength (kgf) | 5 | 4 | 3.5 | 3 | 4 | 3 |
| Elongation (%) | 33 | 45 | 42 | 45 | 35 | 40 |
| Tear strength (kgf/mm) | 1.3 | 1.0 | 1.0 | 1.0 | 1.1 | 1.0 |
| Water absorption (30 min) (%) | 140 | 150 | 180 | 149 | 175 | 153 |
| Water-dispersibility of leather fiber (min) | 10 | <120 | 10 | 120 | 10 | 120 |
| Washing resistance (time) | <10 | 3 | <5 | 3 | <5 | 3 |
| Dimensional stability after washing ( : elongation; no mark: shrinkage) | 1.2 × 1.3 | 3.6 × 5.8 | 1.8 × 3.0 | 4.0 × 6.5 | 1.1 × 1.8 | 3.5 × 6.0 |

*: 4 Parts acrylic dispersant + 34 parts oxyethylene propylene glycol + 2 parts aniline
*1: Basis elongation (%);
denotes shrinkage

TABLE 3

| | Ex-19 | C. Ex-19 | Ex-20 | C. Ex-20 | Ex-21 | C. Ex-21 |
|---|---|---|---|---|---|---|
| Recipe of treatment | Ex-15 | — | Ex-15 | — | Ex-15 | — |
| Aqueous polyurethane | Ref. Ex-1 | — | Ref. Ex-2 | — | Ref. Ex-3 | — |

TABLE 3-continued

| | | | | | | |
|---|---|---|---|---|---|---|
| Component d) of Ex-1 altered to: | — | — | — | — | — | — |
| Leather to be treated | Pig | Pig | Pig | Pig | Pig | Pig |
| Thickness of test leather | 0.6 | 0.6 | 0.6 | 0.6 | 0.5 | 0.6 |
| Tensile strength (kgf) | 5 | 4 | 4 | 3 | 5 | 3 |
| Elongation (%) | 32 | 36 | 40 | 46 | 35 | 48 |
| Tear strength (kgf/mm) | 1.9 | 1.5 | 1.3 | 1.1 | 1.4 | 1.0 |
| Water absorption (30 min) (%) | 285 | 199 | 140 | 150 | 135 | 151 |
| Water-dispersibility of leather fiber | 0.1 | <120 | 10 | <120 | 10 | <120 |
| Washing resistance (time) | <10 | 3 | <8 | 3 | <8 | 3 |
| Dimensional stability after washing, Longitudinal × lateral (%) ( : elongation; no mark: shrinkage) | 1.3 × 2.0 | 3.7 × 5.7 | 1.1 × 1.4 | 3.4 × 6.1 | 1.0 × 1.0 | 3.2 × 6.0 |

| | Ex-22 | C. Ex-22 | Ex-23 | C. Ex-23 | Ex-24 | C. Ex-24 | Ex-25 |
|---|---|---|---|---|---|---|---|
| Recipe of treatment | Ex-15 | — | Ex-15 | — | Ex-15 | — | Ex-1 |
| Aqueous polyurethane | Ref. Ex-4 | — | Ref. Ex-5 | — | Ref. Ex-6 | — | Ref. Ex-1 |
| Component d) of Ex-1 altered to: | — | — | — | — | — | — | Water-soluble melamine |
| Leather to be treated | Pig | Pig | Pig | Pig | Pig | Pig | Pig |
| Thickness of test leather | 0.6 | 0.6 | 0.6 | 0.6 | 0.6 | 0.6 | 0.6 |
| Tensile strength (kgf) | 5 | 3 | 4 | 3 | 5 | 4 | 5 |
| Elongation (%) | 39 | 47 | 37 | 47 | 34 | 36 | 30 |
| Tear strength (kgf/mm) | 1.3 | 1.0 | 1.3 | 1.1 | 1.4 | 1.0 | 1.8 |
| Water absorption (30 min) (%) | 138 | 148 | 136 | 150 | 130 | 146 | 235 |
| Water-dispersibility of leather fiber | 10 | <120 | 10 | <120 | 10 | <120 | 10 |
| Washing resistance (time) | <8 | 3 | <7 | 3 | <7 | 3 | 10 |
| Dimensional stability after washing, Longitudinal × lateral (%) ( : elongation; no mark: shrinkage) | 1.1 × 1.6 | 3.2 × 5.8 | 1.2 × 1.8 | 3.0 × 5.9 | 1.0 × 1.2 | 3.4 × 6.1 | 0.5 × 1.0 |

| | C. Ex-25 | Ex-26 | C. Ex-26 | Ex-27 | C. Ex-27 |
|---|---|---|---|---|---|
| Recipe of treatment | — | Ex-1 | — | Ex-1 | — |
| Aqueous polyurethane | — | Ref. Ex-1 | — | Ref. Ex-1 | — |
| Component d) of Ex-1 altered to: | — | Epoxy CR-5L | — | IPA + AL ethyl acetate diisopropylate | — |
| Leather to be treated | Pig | Pig | Pig | Pig | Pig |
| Thickness of test leather | 0.6 | 0.5 | 0.6 | 0.6 | 0.6 |
| Tensile strength (kgf) | 5 | 5 | 4 | 5 | 4 |
| Elongation (%) | 35 | 28 | 38 | 32 | 35 |
| Tear strength (kgf/mm) | 1.5 | 1.9 | 1.5 | 1.8 | 1.5 |
| Water absorption (30 min) (%) | 200 | 240 | 210 | 255 | 190 |
| Water-dispersibility of leather fiber | <120 | 10 | <120 | 10 | <120 |
| Washing resistance (time) | 3 | <10 | 3 | 5 | <3 |
| Dimensional stability after washing, Longitudinal × lateral (%) ( : elongation; no mark: shrinkage) | 3.2 × 5.8 | 0.8 × 0.5 | 3.3 × 6.1 | 1.0 × 1.5 | 3.5 × 6.0 |

Rate of Moisture Absorption, Quantity of Absorbed Moisture and Loss in Moisture

EXAMPLES 28 (1)-(6)

A cattle wet blue was used. The method of leather treatment was the same as in Example 1. The treating agent was added in an amount of 10% and 15% based on the dry weight of leather.

Further, the time period of dipping was varied. The properties of the leather treated are shown in Table 4.

COMPARATIVE EXAMPLES 28 (1)-(3)

The same wet blue as in Example 28 (1)-(5) was treated in the same manner as in Comparative Example 1, and then used for the test. The results are shown in Table 4.

TABLE 4

| | Test item | Treating agent | Amt. of treating agent | Time of dipping in treating bath 1 hr | 3 hr | 5 hr | 8 hr | 24 hr |
|---|---|---|---|---|---|---|---|---|
| Ex-28 (1) | Moisture absorption (mg/cm$^2$/72 hr) | Ex-1 | 10% | — | 12.4 | — | — | — |
| Ex-28 (2) | Moisture absorption (mg/cm$^2$/72 hr) | Ex-1 | 15% | — | 11.2 | — | — | — |
| C. Ex-28 (1) | Moisture absorption (mg/cm$^2$/72 hr) | — | — | — | 6.8 | — | — | — |
| Ex-28 (3) | Moisture absorption (mg/cm$^2$/72 hr) | Ex-1 | 10% | 0.9 | 1.9 | 3.0 | 4.1 | 9.1 |
| Ex-28 (4) | Moisture absorption (mg/cm$^2$/72 hr) | Ex-1 | 15% | 1.0 | 2.2 | 3.0 | 3.8 | 7.8 |
| c. Ex-28 (2) | Moisture absorption (mg/cm$^2$/72 hr) | — | — | 0.8 | 1.8 | 2.5 | 3.3 | 5.6 |
| Ex-28 (5) | Moisture absorption (mg/cm$^2$/72 hr) | Ex-1 | 10% | 0.8 | 1.5 | 2.3 | 2.9 | 5.2 |
| Ex-28 (6) | Moisture absorption (mg/cm$^2$/72 hr) | Ex-1 | 15% | 0.8 | 1.5 | 2.2 | 3.0 | 5.2 |
| C. Ex-28 (3) | Moisture absorption (mg/cm$^2$/72 hr) | Ex-1 | — | 0.7 | 1.2 | 1.7 | 2.1 | 3.6 |

EXAMPLE 29 (1)-(6)

Example 10 was repeated, except that, as ingredient c) in the treating agent, polyoxyethylene nonylphenyl ethers (manufactured by Sanyo Kasei Kogyo) different in the mole number of added ethylene oxide were used, provided that the amounts of ingredients a), b) and d) were the same as in Example 1.

TABLE 5

| | Mole no. of ethylene oxide added | Effect: in-bath dispersibility handling property | Temp. of leather treatment |
|---|---|---|---|
| Ex-29-1) | 4.0 | Insufficient: difficult to handle with foaming | 35° C. |
| Ex-29-2) | 6.0 | Good: | 35° C. |
| Ex-29-3) | 8.5 | Best: | 35° C. |
| Ex-29-4) | 11.0 | Good: | 35° C. |
| Ex-29-5) | 13.0 | Insufficient: difficult to handle with formation of massy deffated matter | 35° C. |
| Ex-29-6) | 8.5 | Insufficient: difficult to handle with formation of massy deffated matter | 70° C. |

EXAMPLE 30 TREATMENT OF FUR

Kind of fur: mouton (sheet fur)

Preparation of treating solution:

EXAMPLE 30-(1)

The treating agent of Example 1 was weighed out in an amount of 5% by weight based on the weight of fur. Then, 30 times by weight of water having a temperature of 40° C. was weighed out and mixed with the treating agent to prepare a treating solution.

EXAMPLE 30-(2)

The treating agent of Example 3 was weighed out in an amount of 5% by weight based on the weight of fur. Then, 30 times by weight of water having a temperature of 40° C. was weighed out and mixed with the treating agent to prepare a treating solution.

To each of the above-mentioned two treating solutions was added 30 times by weight, based on the weight of fur, of a detergent solution prepared by adding 2 grams of a domestic synthetic detergent to one liter of water, to obtain treating fluids.

Method of treatment: A treating fluid was introduced into a bath, and then a fur to be treated was thrown thereinto and dipped for 6 hours. During this period, upside-down turning and stamping were continued for 10 minutes for the sake of permeation at intervals of two hours, and the fur was left as it was for the remaining 50 minutes.

Thereafter, the fur was rinsed with running water for 3 minutes with stamping, and then dehydrated. This procedure was twice repeated.

After dehydration, the wet fur was hanging-dried in exposure to direct sunlight.

The result of the treatment are shown in Table 6. The following facts are found therefrom:

(1) After the treatment, the hair part was more clean, free from dirts and puffy, as compared with that before the treatment.

(2) After the treatment, the leather part was more flexible and extended in dimension, as compared with that before the treatment.

(3) After the treatment, the fur was lighter in weight, as compared with that before the treatment.

TABLE 6

| | | Ex-30-(1) | | Ex-30-(2) | |
|---|---|---|---|---|---|
| | | Before treat-ment | After treat-ment | Before treat-ment | After treat-ment |
| Treating agent | | — | Ex-1 | — | Ex-3 |
| Up-to-down length | cm | 80.5 | 81.2 | 98.3 | 99.5 |
| Width in upper region | cm | 51.5 | 52.0 | 60.2 | 61.0 |
| Width in central region | cm | 58.2 | 58.6 | 63.5 | 64.2 |
| Width in lower region | cm | 59.6 | 60.2 | 70.0 | 70.8 |
| Weight | kg | 1.120 | 1.090 | 1.390 | 1.340 |

Example 31 (1)-(2): Fibrous Leather Powder Excellent in Water-dispersibility (raw material of leather paper making, raw material of spun yarn for woven fabric)

I) LEATHER TREATING METHOD IN EXAMPLE OF THE INVENTION

Product leathers such as tanned wet blue, dyed leather, fatted leather and the like or waste leathers such as leather waste, trimming waste, shaving waste and the like were used as raw material. Based on the dry weight of raw material, 35% by weight of each treating agent and 70 times by weight of water were mixed together and stirred to prepare a leather treating agent. A test leather was thrown into the treating solution and treated in the same manner as in "Leather Treatment Method in Example of the Invention" mentioned above. When the dipping treatment was completed, the water was discharged and the leather was rinsed in running water and dried in exposure to direct sunlight.

II) METHOD FOR PREPARING LEATHER POWDER (EXAMPLE OF THE INVENTION AND COMPARATIVE EXAMPLE)

A dried leather was made into a fibrous leather powder having a size of 3 mm or below by means of a Turbo Cutter type pulverizer. Solid matter was removed therefrom by means of sieves, and a fibrous leather powder having a size of 1-3 mm was taken out and used in the test.

The procedure of Comparative Example 29 was the same as in Example 31, except that the treated leather was replaced with an untreated leather.

III) FREENESS TEST FOR PAPER-MAKING

The test was conducted according to JIS-P8121, Method for Testing Freeness of Pulp (Canadian Standard Form). The results are shown in Table 7.

The untreated leather of Comparative Example floated on water in the state of a cotton-like material and quite poor in water-dispersibility, so that it could be by no means used as a raw material of paper-making.

TABLE 7

| | C. Ex-29 | Ex-31-(1) | Ex-31-(2) |
|---|---|---|---|
| Treating agent | — | Ex-1 | Ex-4 |
| Kind of leather treated | Cattle | Cattle | Cattle |
| Freeness (ml) | 50–200 (*-1) | 450–760 | 350–580 |

(*-1) The fibrous leather powder of Comparative Example was poor in water-dispersibility, so that it was disintegrated by means of a standard disintegrator at 7,500 rpm for 25 minutes, dispersed in water and immediately tested.

Example 32: Binder Effect of the Treating Agent on Metal Powder or the Like Used in the Production of Antibacterial Leather Leather Treatment Method in Example 32 (1)–(3): The treatment was carried out under the same conditions as in Example 1, except that a metal powder was added to the treating agent of Example 3.

Leather Treatment Method in Example 32 (4)–(5): In a step subsequent to the step of dyeing a chrome-tanned leather, an M% by weight, based on the weight of dry leather, of metal powder was added and stirred at ordinary temperature for 4 hours, after which the liquid was rejected. After air-drying the leather on a ladder for 12 hours, a leather treating solution was prepared from 4% by weight, based on the weight of dry leather, of a treating agent of the invention and 70 times by weight of water. The test leather was thrown into the treating solution and treated in the same manner as in "Leather Treatment Method in Example of the Invention" mentioned above.

Measurement of the Content of Metal Powder or the Like in the Treated Leather: A sample was treated according to JIS-K6550 "Method for Testing Leather" and thereafter analyzed. An X-ray microanalyzer (LINK Co. 9X-2001) was also used Leather Treatment Method in Comparative Example 30: The leather of Example 32 having completed the step of dyeing was treated in the same manner as in "Leather Treatment Method in Comparative Example 1" mentioned above.

For fixing a large quantity of metal powder or the like in the leather-making process, it was necessary to increase the amount of the treating agent as a binder. The use of copper powder in an amount of at least 0.1% by weight was enough for exhibiting an antibacterial effect.

The results of the test are shown in Table 8.

METHOD FOR TREATING FIBER CLOTH

Examples 33–58 and Examples 86–91

A cloth was cut into a relatively large size so that it enabled the measurement of JIS-L-1042-1986G as it was without stretching it nor contracting it, and a mark was put thereon.

A treating agent of the invention, in an amount of 4% by weight based on the weight of test cloth, was mixed into hot water to prepare a treating solution having a concentration of about 0.3%. After adjusting the liquid temperature to 40° C., it was thrown into a domestic electric washing machine together with the test cloth, and operation was started. After stirring for 5 minutes, the cloth was left as it was for 10 minutes. This procedure was repeated twice, so that the total time period of the treatment was 30 minutes. After rejecting the washing solution, fresh water of ordinary temperature was added and rinsing was carried out at 3 minutes. After lightly dehydrating the cloth until its water content reached about 30%, it was hanging-dried and thereafter finished by means of a dry iron at a temperature suitable for the fiber. The treating agent of the invention was used generally in an amount of 0.1–10% based on the weight of the fibrous material.

COMPARATIVE EXAMPLES 31–40

The treatment of the examples of the invention was repeated, except that only hot water having a temperature of 40° C., containing no treating agent, was used.

TESTING METHOD FOR PERCENT SHRINKAGE OF FIBER CLOTH

Washing machine: A machine according to JIS-L-1042-1986 and JIS-L-0217-1976-No. 103 was used.

Method of washing (washing in water): Water having a temperature of 40° C. was introduced into the water tank of a domestic electric washing machine up to the highest water level line, in which was dissolved 2 grams/liter was of a synthetic detergent for clothing to prepare a washing solution. A loading cloth was thrown into the washing solution so as to give a bath ratio of 1:30, and an operation was started with a weak water flow. After a treatment for 5 minutes, the machine was stopped, the cloth was dehydrated until its water content reached about 30%, the washing solution was replaced with fresh water, a rinsing process was carried out at the same bath ratio as above for 2 minutes, and

TABLE 8

| | C Ex-30-① | Ex-32-① | Ex-32-② | Ex-32-③ | C. Ex-30-② | Ex-32-④ | C. Ex-32-⑤ |
|---|---|---|---|---|---|---|---|
| Treating agent | — | Ex-3 | Ex-3 | Ex-3 | — | Ex-4 | Ex-4 |
| Leather treated | Pig | Pig | Pig | Pig | Cattle | Cattle | Cattle |
| Metal powder (M) (larger than 10 μm) | — | Cu | Cu + Al | Cu | — | Cu | Cu + Anti-bacterial (*-1) |
| Amt. of metal powder (%) (M) | — | 0.5 | 3 + 2 | 6 | — | 3 | 0.5 |
| Retention of metal powder after washing 5 times (%) | — | 0.1 | 0.6 + 0.3 | 1.1 | — | 0.5 | 0.1 |
| Growth-inhibition on bacteria (Note 1) | None | Good | Good | Good | Non | Good | Good |
| Content of metal powder in treated leather (%) | None | 0.1 | 0.7 + 0.4 | 1.3 | None | 0.5 | 0.1 |

(*-1) Fineside #600, manufactured by Tokyo Fine Chemical Co., Ltd.
(Note 1)
Testing method: AATCC Test method 90 and its modification; evaluated on the 5th day after the start.
Test strains: *Staphylococcus aureus* ATCC 6538 (IFO-12732); *Trichophyton mentagrophytes* IFO 6202
Testing method: JIS Z2911, 6, 2, 2 Wet method; evaluated one week after the start.
Test fungi: *Aspergillus niger* (FERM S-1), *Penicillium cilrinum* (FERM S-5), *Myrothecium verrucaria* (FERM S-13), *Chaetomium globosum* (FERM S-11).

then the cloth was dehydrated until its water content reached about 30%. After twice repeating this procedure, the loading cloth was hanging-dried, lightly stretched to smooth the wrinkles, and dried. Then, the cloth was finished by means of dry iron at a temperature suitable for the fiber.

Manual washing: It was carried out according to JIS-L-1042-1986 and JIS-L-0217-1976-No. 106.

A washing solution was prepared by adding 2 grams/liter of a weakly alkaline or neutral detergent to water.

A cloth was successively subjected to manual press-washing for 2 minutes, manual press-squeezing, rinsing, dehydration by means of a dehydrating machine (till the water content reached 30%), hanging-drying, smoothing the wrinkles (with a light stretching), drying in the direct sunlight, and finishing by means of dry iron.

Test Cloth: According to JIS-L-1042-1986 "Test for Washing Shrinkage, Method E), test pieces having a size of 25 cm (width)×25 cm (length) were used. Three test pieces were used for every run. After the treatment, each test piece was conditioned in the standard state and placed on a flat table, unnatural wrinkles and tensions were eliminated, and lengths of three length-measurement intervals (mm) in the directions of warp and weft, respectively, were measured, to the order of integer.

CALCULATION OF PERCENT SHRINKAGE

From the three length-measurement intervals, average values were calculated for each of the warp direction and the weft direction. Percent shrinkage was calculated according to the following equation. In each of warp and weft directions, a mean value was taken from three test pieces, to the order of $10^{-1}$.

$$\text{Percent shrinkage upon washing in water (\%)} = \frac{L - L'}{L} \times 100$$

wherein L is length of the interval before the treatment (mm), and L' is length of the interval after the treatment (mm), provided that a negative value of percent shrinkage means an elongation.

PERCENT CHANGE

The change in length brought about by treatment of a fiber cloth with the treating agent of the invention was measured in the same manner as in the test of percent shrinkage on test cloth mentioned above.

CALCULATION OF PERCENT CHANGE

From the three length-measurement intervals, average values were calculated for each of the warp direction and the weft direction. Percent change was calculated according to the following equation. In each of warp and weft directions, a mean value was taken from three test pieces, to the order of $10^{-1}$.

$$\text{Percent change upon washing in water (\%)} = \frac{l - l'}{l} \times 100$$

wherein l is length of the interval before treatment (mm), and l is length of the interval after the treatment (mm), provided that a negative value of percent change means elongation.

Properties of Cloths Treated and Untreated with the Agent of the Invention

METHODS OF THE TEST

Test on tensile strength and elongation: Tensile strength and elongation were measured according to JIS-L-1096-1990 "Testing Method on General Textiles, 6, 12, 1, Method A (Strip Method)", using constant speed tensile testing machine, tensile speed 20 cm/min, width of test piece 5 cm, cramp interval 20 cm.

Pilling test (A): According to JIS-L-1076-1985, 6. 1 "Pilling Test on Woven Fabrics and Knit fabrics, Method (A)", using ICI type tester, test time 10 hours.

Bending test: Using KES-$FB_2$ pure bending tester, SENS 2×1, test dimension 20 cm×20 cm, direction of test: longitudinal and lateral directions.

Compression test: Using KES-$FB_3$ compression tester, SENS 2×5, descending speed of press plate: 1 mm/50 sec, area of press plate: 2 $cm^2$ (circular), maximum deformation: 5 mm.

The results of treatment of fiber cloth are shown in Table 9 (1)-(4) and Table 10 (1)-(4).

Table 9 (1)-(4) illustrate percent change, percent shrinkage and hand of fiber cloths subjected to a shrink-proofing treatment using treating agents of varied formulation.

Table 10 (1)-(2) illustrate results of test on various properties of fiber cloths subjected to a shrink-proofing treatment.

Table 10 (3)-(4) illustrate results of test on various properties (hand) of fiber cloths subjected to a shrink-proofing treatment.

CLOTHS USED IN THE TEST (1) Examples 33-46 and Comparative Example 31
Wool 100% georgette gray fabrics of one lot were used.

(2) Example 47 and Comparative Example 32
Silk plain weave gray fabrics of one lot were used.

(3) Example 48 and Comparative Example 33
Cotton towel cloth of one lot were used.

(4) Example 49 and Comparative Example 34
Flax plain weave fabrics of one lot were used.

(5) Example 50 and Comparative Example 35
Wool 100% georgette gray fabrics of one lot were used.

(6) Examples 51-52 and Comparative Example 36
Wool 100% georgette gray fabrics of one lot were used.

(7) Example 53-54 and Comparative Example 37
Wool 100% georgette gray fabrics of one lot were used.

TABLE 9

Percent change, percent shrinkage and hand of fiber cloth subjected to shrinkproofing treatment with a treating agent of varied formulation

| | Ex-33 | Ex-34 | Ex-35 | Ex-36 | Ex-37 |
|---|---|---|---|---|---|
| a) Component: aqueous urethane (parts) | 88 | 25 | 98 | 88 | 88 |

TABLE 9-continued

Percent change, percent shrinkage and hand of fiber cloth subjected to shrinkproofing treatment with a treating agent of varied formulation

| | | | | | |
|---|---|---|---|---|---|
| (Polyurethane used) | Ref. Ex-1 | Ref. Ex-1 | Ref. Ex-1 | Ref. Ex-2 | Ref. Ex-3 |
| b) Component: polyvalent metal salt (parts) | 2.5 | 5 | 0.5 | 2.5 | 2.5 |
| (Metal used salt) | Al sulfate | Al sulfate + Zr sulfate | Al sulfate | Na aluminate | Na aluminate |
| C) Component: surfactant (parts) | 7.5 | 30 | 1.5 | 7.5 | 7.5 |
| (Kind of emulsifier) | Nonionc | Nonionic + Anionic | Nonionic | Nonionic | Nonionic |
| d) Component: auxiliary (parts) | 2 | 40 | 0 | 2 | 2 |
| (Kind of auxiliary) | Acrylic dispersant | * | — | Acrylic dispersant | Acrylic dispersant |
| Woven fabric treated | Wool 100% georgette gray fabric | Wool 100% georgette gray fabric | Wool 100% georgette gray fabric | Wool 100% georgette gray fabric | Wool 100% georgette gray fabric |
| Percent change (%) Longitutinal × lateral | Δ0.2 × 0.8 | Δ0.4 × 1.2 | 0.0 × 00 | 0.1 × 1.0 | Δ0.1 × 0.4 |
| Percent shrinkage (%) 1st time (Longitudinal × lateral) | 0.8 × 1.8 | 1.2 × 2.0 | 0.5 × 1.0 | 0.2 × 1.2 | 0.0 × 1.0 |
| Percent shrinkage (%) 3rd time (Longitudinal × lateral) | 1.2 × 2.4 | 1.4 × 2.8 | 0.7 × 0.8 | 0.3 × 1.6 | 0.0 × 1.0 |
| Hand (after washing in water) | Very good | Very good | Very good | Good | Good |

| | Ex-38 | Ex-39 | Ex-40 | Ex-41 | Ex-42 | Ex-43 |
|---|---|---|---|---|---|---|
| a) Component: aqueous urethane (parts) | 88 | 88 | 88 | 70 | 55 | 99.8 |
| (Polyurethane used) | Ref. Ex-4 | Ref. Ex-5 | Ref. Ex-6 | Ref. Ex-3 | Ref. Ex-1 + Ref. Ex-3 | Ref. Ex-3 |
| b) Component: polyvalent metal salt (parts) | 2.5 | 2.5 | 2.5 | 15 | 2.5 | 0 |
| (Metal used salt) | Na aluminate | Na aluminate | Na aluminate | Na aluminate + Zr sulfate | Al sulfate + Na aluminate | |
| C) Component: surfactant (parts) | 7.5 | 7.5 | 7.5 | 7.5 | 40 | 0.2 |
| (Kind of emulsifier) | Nonionic | Nonionic | Nonionic | Nonionic | Nonionic + anionic betaine type | Nonionic |
| d) Component: auxiliary (parts) | 2 | 2 | 2 | 7.5 | 2.5 | 0 |
| (Kind of auxiliary) | Acrylic dispersant | Acrylic dispersant | Acrylic dispersant | Acrylic dispersant | Acrylic dispersant | — |
| Woven fabric treated | Wool 100% georgette gray fabric | Wool 100% georgette gray fabric | Wool 100% georgette gray fabric | Wool 100% georgette gray fabric | Wool 100% georgette gray fabric | Wool 100% georgette gray fabric |
| Percent change (%) Longitutinal × lateral | Δ0.1 × 0.5 | 0.3 × 1.6 | 0.1 × 0.4 | 0.0 × 1.0 | 1.0 × 0.8 | Δ0.1 × 0.3 |
| Percent shrinkage (%) 1st time (Longitudinal × lateral) | Δ0.1 × 0.8 | 0.1 × 1.3 | 0.2 × 1.0 | 0.2 × 1.0 | 0.8 × 1.2 | 0.5 × 1.0 |
| Percent shrinkage (%) 3rd time (Longitudinal × lateral) | 0.6 × 1.3 | 0.3 × 1.3 | 0.2 × 1.2 | 0.8 × 1.4 | 1.1 × 2.5 | 0.5 × 1.6 |
| Hand (after washing in water) | Good | Good | Good | Good | Very good | Good |

| | Ex-44 | Ex-45 | Ex-46 | C. Ex-31 | Ex-47 |
|---|---|---|---|---|---|
| a) Component: aqueous urethane (parts) | 85 | 80 | 88 | — | 88 |
| (Polyurethane used) | Ref. Ex-1 | Ref. Ex-1 | Ref. Ex-1 + Ref. Ex-3 | — | Ref. Ex-3 |
| b) Component: polyvalent metal salt (parts) | 5 | 12 | 2.5 | — | 2.5 |
| (Metal used salt) | Al sulfate | Al sulfate | Al sulfate + Na aluminate | — | Na aluminate |
| C) Component: surfactant (parts) | 7.5 | 7.5 | 7.5 | — | 7.5 |
| (Kind of emulsifier) | Nonionic | Nonionic | Nonionic | — | Nonionic |
| d) Component: auxiliary (parts) | 2.5 | 0.5 | 2 | — | 2 |
| (Kind of auxiliary) | Acrylic dispersant | Acrylic dispersant | Acrylic dispersant | — | Acrylic dispersant |
| Woven fabric treated | Wool 100% georgette gray fabric | Wool 100% georgette gray fabric | Wool 100% georgette gray fabric | Wool 100% georgette gray fabric | silk, plain weave, gray fabric |
| Percent change (%) Longitutinal × lateral | 0.1 × 0.6 | 0.0 × 0.4 | Δ0.1 × 0.1 | 2.4 × 5.6 | 10.8 × 12.8 |
| Percent shrinkage (%) 1st time (Longitudinal × lateral) | 0.6 × 1.4 | 0.2 × 1.0 | 0.0 × 0.3 | 3.6 × 7.0 | Δ0.8 × Δ1.8 |
| Percent shrinkage (%) 3rd time (Longitudinal × lateral) | 1.0 × 2.0 | 1.0 × 1.6 | 0.2 × 0.8 | 4.3 × 8.0 | Δ0.6 × 1.2 |
| Hand (after washing in water) | Good | Good | Good | Inferior | Good |

| | C. Ex-32 | Ex-48 | C. Ex-33 | Ex-49 | C. Ex-34 |
|---|---|---|---|---|---|
| a) Component: aqueous urethane (parts) | — | 88 | — | 88 | — |
| (Polyurethane used) | — | Ref. Ex-3 | — | Ref. Ex-3 | — |
| b) Component: polyvalent metal salt (parts) | — | 2.5 | — | 2.5 | — |
| (Metal used salt) | — | Na aluminate | — | Na aluminate | — |

TABLE 9-continued

Percent change, percent shrinkage and hand of fiber cloth subjected to shrinkproofing treatment with a treating agent of varied formulation

| | | | | | |
|---|---|---|---|---|---|
| C) Component: surfactant (parts) | — | 7.5 | — | 7.5 | — |
| (Kind of emulsifier) | — | Nonionic | — | Nonionic | — |
| d) Component: auxiliary (parts) | — | 2 | — | 2 | — |
| (Kind of auxiliary) | — | Acrylic dispersant | — | Acrylic dispersant | — |
| Woven fabric treated | Silk, plain weave, gray fabric | Cotton, towel fabric | Cotton, towel fabric | Flax, plain weave fabric | Flax, plain weave fabric |
| Percent change (%) Longitutinal × lateral | 22.6 × Δ8.6 | Δ0.2 × Δ0.1 | 2.6 × 1.5 | 1.4 × 0.0 | 3.4 × 2.2 |
| Percent shrinkage (%) 1st time (Longitudinal × lateral) | 23.3 × Δ9.6 | 0.3 × 0.1 | 2.4 × 1.6 | 1.8 × 1.2 | 4.3 × 3.6 |
| Percent shrinkage (%) 3rd time (Longitudinal × lateral) | 24.8 × Δ10.5 | 0.6 × 0.4 | 2.8 × 2.1 | 2.3 × 1.8 | 7.8 × 6.4 |
| Hand (after washing in water) | Good | Good | Good | Good | Good |

*4 Parts acrylic dispersant + 34 parts oxyethylene propylene glycol + 2 parts aniline

TABLE 10

Results of tests on the properties of fiber cloths subjected to shrinkproofing treatment

| Fabric | | C. Ex-35 Wool 100% Untreated fabric | Ex-50 Wool 100% Treated fabric | C. Ex-36 Wool 100% Untreated fabric | Ex-51 Wool 100% Treated fabric |
|---|---|---|---|---|---|
| Treating agent | | — | Ex-33 | — | Ex-44 |
| Method of treatment | | C. Ex-31 | Ex-33 | C. Ex-31 | Ex-33 |
| Tensile strength (kg) | longitudinal | 65.0 | 67.0 | 55.1 | 49.9 |
| | lateral | 40.0 | 41.2 | 30.1 | 30.0 |
| Elongation (%) | longitudinal | 50.0 | 53.4 | 54.6 | 58.6 |
| | lateral | 36.0 | 36.5 | 30.5 | 26.1 |
| Piling (grade) | | 4 Fluff | 3 Fluff | 5 | 4–5 Fluff |
| Bending | Bending stiffness (g · cm²/cm) | 0.223 | 0.150 | 0.162 | 0.095 |
| | Bending recovery (g · cm/cm) | 0.320 | 0.112 | 0.192 | 0.061 |
| Compression | Compression stiffness | 0.451 | 0.447 | 0.265 | 0.288 |
| | Work of compression (g · cm/cm²) | 0.500 | 0.700 | 0.296 | 0.280 |
| | Compression recovery (%) | 51.2 | 49.1 | 55.0 | 55.1 |
| | Thickness under 0.5 g/cm²: TO | 1.092 | 1.531 | 1.003 | 0.983 |
| | Thickness under 50 g/cm²: TM | 0.652 | 0.902 | 0.553 | 0.589 |
| | Compressibility (%) $= \frac{TO - TM}{TO} \times 100$ | 40.3 | 41.1 | 44.9 | 40.1 |
| Compression ratio longitudinal × lateral | | 3.3 × 1.6 | 1.0 × 1.0 | 1.0 × 4.6 | 0.0 × 1.0 |

| Fabric | | Ex-52 Wool 100% Treated fabric | C. Ex-37 Wool 100% Untreated fabric | Ex-53 Wool 100% Treated fabric | Ex-54 Wool 100% Treated fabric |
|---|---|---|---|---|---|
| Treating agent | | Ex-45 | — | Ex-43 | Ex-46 |
| Method of treatment | | Ex-33 | — | Ex-33 | Ex-33 |
| Tensile strength (kg) | longitudinal | 52.3 | 52.23 | 49.80 | 50.45 |
| | lateral | 31.0 | 42.48 | 40.36 | 41.78 |
| Elongation (%) | longitudinal | 55.0 | 34.90 | 43.46 | 43.62 |
| | lateral | 27.0 | 35.87 | 39.95 | 38.84 |
| Piling (grade) | | 4–5 Fluff | 4–5 Fluff | 4–5 Fluff | 4–5 Fluff |
| Bending | Bending stiffness (g · cm²/cm) | 0.100 | 0.115 | 0.115 | 0.113 |
| | Bending recovery (g · cm/cm) | 0.065 | 0.037 | 0.047 | 0.048 |
| Compression | Compression stiffness | 0.290 | 0.330 | 0.373 | 0.378 |
| | Work of compression (g · cm/cm²) | 0.251 | 0.238 | 0.311 | 0.313 |
| | Compression recovery (%) | 57.0 | 59.80 | 58.45 | 58.35 |
| | Thickness under 0.5 g/cm²: TO | 0.947 | 0.830 | 0.932 | 0.938 |
| | Thickness under 50 g/cm²: TM | 0.594 | 0.534 | 0.612 | 0.603 |
| | Compressibility (%) $= \frac{TO - TM}{TO} \times 100$ | 37.2 | 34.6 | 34.3 | 35.7 |
| Compression ratio longitudinal × lateral | | 0.0 × 0.8 | 3.0 × 2.0 | 1.4 × 1.1 | 1.1 × 0.8 |

| | C. Ex-37 Wool 100% Untreated fabric | C. Ex-54 Wool 100% Treated fabric |
|---|---|---|

TABLE 10-continued

| Properties | Item | Unit | — | Ex-46 |
|---|---|---|---|---|
| | Treating agent | | — | Ex-33 |
| | Method of treatment | | (*) | (*) |
| Tensile | Elongation | EM (%) | 6.1425 | 7.6300 |
| | Linearity | LT (—) | 0.5623 | 0.5485 |
| | Work | WT (g · cm/cm$^2$) | 8.6025 | 10.4700 |
| | Resilience | RT (%) | 75.0000 | 72.1500 |
| Bending | Stiffness | B (g · cm/cm$^2$) | 0.1128 | 0.1138 |
| | Hysteresis | 2HB (g · cm/cm) | 0.0364 | 0.0485 |
| Shearing | Stiffness | G (g · cm/degree) | 0.6400 | 0.7025 |
| | Hysteresis at 0.5° angle | 2HG (g/cm) | 0.4975 | 0.7675 |
| | Hysteresis at 5° angle | 2HG5 (g/cm) | 1.2050 | 1.4700 |
| Compression | Linearity | LC (—) | 0.3113 | 0.3017 |
| | Work | WC (g/cm/cm$^2$) | 0.2400 | 0.3660 |
| | Resilience | RC (%) | 61.7333 | 59.4333 |
| Surface | Friction coeff. | MIU (—) | 0.1805 | 0.1975 |
| | Variation in friction coeff. | MMD (—) | 0.0141 | 0.0157 |
| | Variation in uneveness | SMD (micron) | 3.0602 | 3.3867 |
| Thickness | Thickness | T (mm) | 0.8383 | 1.0963 |
| Weight | Weight | W (mg/cm$^2$) | 26.1900 | 27.6400 |
| Hand | Stiffness | H · V | 4.9964 | 4.5766 |
| | Smoothness | H · V | 6.1235 | 6.1528 |
| | Fullness and softness | H · V | 6.0957 | 7.1893 |
| | Overall | T · H · V | 3.7833 | 3.6889 |

(*) Measured in Tokyo Pref. Fiber Industry Test Station

| Properties | Notes | Testing methods |
|---|---|---|
| Tensile | A greater value means a greater extensibility.<br>A value closer to unity means a greater tensile rigidity.<br>A greater value means a greater extensibility.<br>A value closer to 100 means a better recovery. | KES-FB1 Tensile shearing, SENS 5 × 5, test span 20 cm, test length 5 cm, tensile speed 0.2 mm/sec, maximum load 500 g/cm |
| Bending | A greater value means a greater bending rigidity.<br>A greater value means a worse recovery. | KES-FB2 Pure Bending Tester, SENS 2 × 1, test span 20 cm, test length 5 cm |
| Shearing | A greater value means a greater shearing rigidity.<br>A greater value means a worse recovery in the early shearing deformation.<br>A greater value means a worse recovery. | Tensile Shearing Tester, SENS 2 × 5, test span 20 cm, test length 5 cm, hysteresis 2HG; 0.5°, 2HG5; 5.0°, weight 10 g/cm |
| Compression | A value closer to unity means a greater compression regidity.<br>A greater value means a greater compressibility.<br>A value closer to 100 means a better recovery. | KES-FB3 Compression Tester, SENS 2 × 5, pressed area 2 cm$^2$ (disk), pressing speed 50 sec/mm, maximum load 50 g/cm$^2$ |
| Surface | A greater value means a lower slippiness.<br>A greater value means a lower smoothness.<br>A greater value means a greater surface uneveness. | KES-FB3 Surface Tester, SENS 2 × 5, friction speed 0.1 cm/sec, weight 60 g |
| Thickness | A greater value means a greater thickness. | Pressure 0.5 g/cm$^2$ · hr |
| Weight | A greater value means a greater weight. | mg/cm$^2$ |
| Hand | H · V = 10; strong, H · V = 1; weak<br>H · V = 10; strong, H · V = 1; weak<br>H · V = 10; strong, H · V = 1; weak<br>T · H · V = 5; excellent, T · H · V = poor | (*) Measured in Tokyo Pref. Fiber Industry Test Station |

Table 11 illustrates the shrink resistant effect exhibited when washing is repeated, as well as the effect brought about by again treating the washed material with a treating agent of the invention.

TABLE 11

| | First treatment | | Percent shrinkage after repeated washing (%) | | | | |
|---|---|---|---|---|---|---|---|
| | Treating agent | Percent change (%) longitudinal × lateral → | Washing time in dilute detergent solution → | First time longitudinal × lateral → | Third time longitudinal × lateral → | Percent change after re-treatment with the treating agent of the invention (%) longitudinal × lateral | Quality of tested fiber cloth |
| C. Ex-38 | Hot water | 0.6 × 5.0 | 5 min. | 0.7 × 4.7 | 1.0 × 7.0 | — | Wool 100% |
| | | | 30 | 0.8 × 5.5 | 1.3 × 7.0 | Ex-37 | georgette |
| | | | | | | Δ0.6 × Δ1.6 | |
| | | | 60 | 1.0 × 7.0 | 1.5 × 8.0 | — | |
| Ex-55 | Ex-33 | 0.8 × 1.3 | 5 | 0.8 × 1.7 | 1.2 × 3.0 | Δ0.2 × Δ0.5 | Wool 100% |
| | | | 30 | 0.7 × 1.8 | 1.0 × 2.7 | Δ0.5 × Δ0.8 | georgette |
| | | | 60 | 0.7 × 1.5 | 1.3 × 2.5 | Δ1.0 × Δ1.0 | |
| Ex-56 | Ex-37 | 0.0 × 2.0 | 5 | 0.0 × 1.0 | 0.0 × 2.0 | Δ0.8 × Δ0.8 | Wool 100% |
| | | | 30 | 0.0 × 1.0 | 0.0 × 2.6 | Δ0.5 × Δ0.5 | georgette |
| | | | 60 | 0.0 × 1.0 | 0.0 × 2.1 | 0.0 × Δ0.1 | |
| Ex-57 | Ex-43 | Δ0.3 × 2.7 | 5 | 0.2 × 0.8 | 0.4 × 2.4 | Δ1.0 × Δ1.0 | Wool 100% |
| | | | 30 | 0.2 × 0.8 | 0.3 × 2.6 | Δ0.8 × Δ1.1 | georgette |
| | | | 60 | 0.2 × 0.8 | 0.6 × 2.8 | Δ0.5 × Δ2.1 | |
| C. Ex-39 | Hot water | 6.5 × 2.0 | 5 | 2.7 × 2.2 | 3.2 × 2.6 | — | Cotton 100%, |

TABLE 11-continued

| | First treatment | | Percent shrinkage after repeated washing (%) | | | | |
|---|---|---|---|---|---|---|---|
| | Treating agent | Percent change (%) longitudinal × lateral → | Washing time in dilute detergent solution → | First time longitudinal × lateral → | Third time longitudinal × lateral → | Percent change after re-treatment with the treating agent of the invention (%) longitudinal × lateral | Quality of tested fiber cloth |
| | | | 30 | 4.3 × 2.6 | 4.6 × 3.8 | Ex-33 Δ0.8 × Δ2.4 | broad cloth |
| C. Ex-58 | Ex-33 | 3.0 × 1.0 | 5 | 0.8 × 0.3 | 1.0 × 0.5 | Δ0.4 × Δ0.6 | Cotton 100%, |
| | | | 30 | 2.3 × 1.1 | 2.6 × 2.1 | Δ0.8 × Δ1.0 | broad cloth |

Δ: Means elongation

WASHING TEST ON KNIT PRODUCTS AND SEWN PRODUCTS

Wool products and fur products (knit products) such as sweater, cardigan, drawers, muffler and the like, wool products or mixed yarn products of wool and synthetic fiber such as suits for male, skirts for female and the like, silk products such as necktie, scarf and the like, shirts made of flax or cotton, and feather products were washed in water according to the invention. As the results, no shrinkage occurred and the materials could be cleaned more than in dry cleaning. Further, the washed materials were good in hand, showed some extent of extension rather than shrinkage, and a sufficient dimensional stability in spite of the washing in water. Particularly, coarsely knit articles having contracted during wearing showed a great extent of extension, and could recover the original dimension. Although a certain extent of discoloration or deepening of color was observed in some products, such a change gave no impression of an important deterioration in appearance.

The results of test are summarized in Table 12, wherein:

a is height length, b is upper width (back, breast, abdomen, etc.), c is lower width (skirt, etc.), and d is sleeve length or thickness.

EXAMPLE 59–85

[Method of Treatment] Washing Test on Knit and Sewn Products

A knit product or sewn product to be treated was weighed. Based on its weight, an undiluted solution of the treating agent of the invention was weighed out in an amount of 3–5% by weight, depending on the extent of stain and thickness of cloth. Further, an equal quantity of clothing detergent was weighed out. They were mixed together and made into an aqueous solution having a concentration of about 0.15%. After heating the solution to 40° C., the material to be washed was sunk under the water surface in a vessel and lightly washed with crumpling (in case of washing machine, the material was wrapped in net and rotated for 5 minutes), after which it was left dipping for 30 minutes. Then, the washing solution was rejected, and the material was twice rinsed with water at 40° C., dehydrated until its water content reached about 30%, and hanging-dried. Then, it was lightly stretched to smooth the wrinkles and dried in the direct sunlight. Then, it was finished by ironing at a temperature suitable for the fiber. Before the treatment, the original dimension had been measured and recorded.

TABLE 12

| | | Results of washing test on knit fabric, woven fabric and fur | | | | | | | | | |
|---|---|---|---|---|---|---|---|---|---|---|---|
| | | After washing (cm) | | | | | | Before washing (cm) | | | |
| EX. No. | Material washed | Treating agent | a Height length | b Upper width | c Lower width | d Sleeve length thickness | Washability | a Height length | b Upper width | c Lower width | d Sleeve length thickness |
| 59 | Sweater, wool 100% | Ex-33 | 59 | 14 | 33 | 71 | Very good | 58 | 14.5 | 35 | 65 |
| 60 | Sweater, wool 100% | 37 | 49 | 39.5 | 29 | 55 | Very good | 47 | 38 | 29 | 52 |
| 61 | Sweater, wool + cashmere | 37 | 47 | 39 | 29 | 58 | Very good | 46 | 38.5 | 28.5 | 55 |
| 62 | Cardigan, wool 100% | 33 | 62 | 13 | 36 | 68 | Very good | 60 | 12 | 38 | 67 |
| 63 | Cardigan, wool 100% | 37 | 56.5 | 11 | 36 | 67 | Very good | 57 | 10 | 37 | 65 |
| 64 | Cardigan, wool-polyester | 37 | 56 | 18 | 29 | 52 | Very good | 55.5 | 17.5 | 29 | 51 |
| 65 | Overclothe, wool 100% | 33 | 71.5 | — | 51 | 55 | Very good | 71 | — | 51 | 54.5 |
| 66 | Overclothe, wool-flax | 37 | 75 | — | 52 | 57.5 | Very good | 74 | — | 52 | 57 |
| 67 | Pantaloon, wool 100% | 33 | 92.5 | 67 | 23 | — | Very good | 92 | 67 | 23 | — |
| 68 | Pantaloon, wool-flax | 37 | 93 | 41.5 | 24 | — | Very good | 93 | 42 | 24 | — |
| 69 | Overcoat, wool 100% | 37 | 83 | — | 61 | 68.5 | Very good | 82.5 | — | 61 | 68 |
| 70 | Skirt, wool 100% | 33 | 60 | 40 | 56.5 | — | Very good | 60 | 40 | 56 | — |
| 71 | Skirt, wool 100% | 37 | 62.5 | 40 | 54.5 | — | Very good | 62 | 40 | 54.5 | — |
| 72 | Skirt, wool-synthetic | 37 | 62 | 39.5 | 55 | — | Very good | 61 | 39.5 | 55.5 | — |
| 73 | Muffler, wool 100% | 37 | 135.5 | 30.5 | — | — | Very good | 134 | 29.5 | — | — |
| 74 | Socks, wool 100% | 33 | 39 | 7.5 | 10.5 | — | Very good | 37 | 7 | 10 | — |
| 75 | Socks, wool 100% | 37 | 42 | 7.5 | 8.5 | — | Very good | 40.5 | 7.5 | 8.8 | —(*) |
| 76 | Necktie, silk 100% | 33 | 141.5 | 11 | 4.6 | — | Very good | 140 | 11 | 4.6 | — |
| 77 | Necktie, silk 100% | 37 | 137 | 11 | 4.5 | — | Very good | 136 | 10.5 | 4.3 | — |
| 78 | Necktie, silk 100% | 43 | 143 | 8.3 | 4.2 | — | Very good | 143 | 8.0 | 4.1 | — |
| 79 | Shirt, flax | 37 | 76 | 44 | — | 57.5 | Very good | 75.8 | 42.5 | — | 58 |
| 80 | Skirt, cotton | 37 | 78 | 44.5 | — | 56.5 | Very good | 78 | 44.5 | — | 56.7 |
| 81 | Feather quilt | 33 | 205 | 151 | — | 5.5 | Very good | 200 | 150 | — | 4.5 |
| 82 | Feather bourson | 37 | 56.5 | 62.5 | 38.5 | 2.2 | Very good | 56 | 62 | 38 | 1.6 |

TABLE 12-continued

| EX. No. | Material washed | Treating agent | After washing (cm) a Height length | b Upper width | c Lower width | d Sleeve length thickness | Wash-ability | Before washing (cm) a Height length | b Upper width | c Lower width | d Sleeve length thickness |
|---|---|---|---|---|---|---|---|---|---|---|---|
| 83 | Mouton (fur) | 33 | 110.5 | 64.8 | 71.6 | — | Very good | 109.5 | 64.5 | 71 | — |
| 84 | Washed with neutral detergent only | — | 39.9 | 7.2 | 8.0 | — | Very good | 40.5 | 7.5 | 8.8 | —(*) |
| 85 | Treated with treating agent, then washed, and again washed | 37 | 41.5 | 7.5 | 8.5 | — | Very good | 42 | 7.5 | 8.5 | —(*) |

(*)Socks of Ex-75 was used.

EXAMPLES 86–91 AND COMPARATIVE EXAMPLE 40

Table 13 illustrates the percent shrinkage after washing, wherein the conditions of treatment, i.e. concentration of treating solution, bath ratio, temperature of treating solution and time of treatment, were varied.

Treating agent: Example 46

Method of treatment: The same as in Example 1 (Method of treatment of fiber cloth), except that the conditions of treatment were varied.

Fabric used: Wool 100% georgette twill stripe gray fabrics of one lot were used.

TABLE 13

| | Concn. of treating solution (diluted treating fluid) | Bath ratio (fabric: treating fluid, by wt.) | Bath temp. (°C.) | Time of treatment (min.) | Percent change (L' %) (longitudinal × lateral) | Percent shrinkage after the first washing (L'' %) | Percent shrinkage after the second washing (L''' %) | Total percentage of shrinkage $\left(\frac{L - L'''}{L} \times 100\%\right)$ |
|---|---|---|---|---|---|---|---|---|
| | | | Percent shrinkage after washing under varied conditions | | | | | |
| Ex-87 | 0.30 | 1:10 | 15 | 5 | Δ0.2 × 1.5 | Δ2.3 × 1.9 | Δ0.4 × 0.6 | Δ2.8 × 3.9 |
| Ex-88 | 0.10 | 1:30 | 15 | 5 | Δ1.4 × 1.7 | Δ1.6 × 1.2 | 0.0 × 0.6 | Δ2.9 × 3.6 |
| Ex-89 | 0.10 | 1:30 | 15 | 15 | Δ1.0 × 0.4 | Δ2.1 × 1.6 | 0.2 × 0.7 | Δ2.6 × 2.8 |
| Ex-90 | 0.10 | 1:30 | 40 | 15 | Δ1.3 × 1.4 | Δ2.6 × 1.5 | 0.9 × 0.4 | Δ2.9 × 3.9 |
| Ex-91 | 0.03 | 1:30 | 40 | 30 | Δ1.2 × 1.9 | Δ2.1 × 1.5 | 0.9 × 0.3 | Δ2.7 × 3.5 |
| C. Ex-40 | — | 1:100 | 40 | 30 | 0.7 × 2.5 | 0.3 × 0.8 | 0.3 × 0.7 | 1.3 × 4.1 |

Δ: Denotes extensions.
Note:
Percents of shrinkage are expressed by (longitudinal × lateral).

EFFECT OF THE INVENTION

Leather and fur treated with the treating agent of the invention can be washed in water. Even washed in water, they retain flexibility, have an excellent dimensional stability and are enhanced in water absorption into leather fiber. Further, they are improved in tear strength, tensile strength and hand and become easy to sew by means of domestic sewing machine.

When woven, knit and unwoven fabrics made of natural fibers such as animal hair, wool, silk, cotton and the like or their mixed fabrics with synthetic fibers are treated with the treating agent of the invention, a dimensional stability and shrink resistance after washing can be given to them without affecting their hand.

What is claimed is:

1. A treating agent composition for leather, fur and fibrous material comprising:

(a) a member selected from the group consisting of a water-soluble polyurethane, a water-dispersible polyurethane and mixtures thereof in amount of 30–99% by weight, (b) a member selected from the group consisting of an aluminum salt, a chromium salt and a zirconium salt in an amount of 0.2–15% by weight, (c) a surfactant comprising at least one nonionic surfactant which is an ethylene oxide adduct having 5–11 moles of ethylene oxide units on the average in amount of 0.2–30% by weight wherein said ethylene oxide adduct is selected from the group consisting of polyoxyethylene alkylphenyl ethers having an average of from 6 to 12 carbon atoms in the alkyl group, polyoxyethylene alkyl ethers having an average of from 10 to 20 carbon atoms in the alkyl group, polyoxyethylene alkenyl ethers having an average of from 10 to 20 carbon atoms in the alkenyl group, ethoxylated fatty acid alkanolamides and polyoxyethylenepolyoxypropylene alkyl ethers; and (d) auxiliary ingredients conventionally used in such leather, fur and other fibrous treating compositions, other than components (a)–(c), in amount of 0 to 20% by weight, when the total quantity of ingredients (a), (b), (c) and (d) are taken as 100% by weight.

2. A treating agent according to claim 1 in which component (a) is present in amount of 70–98% by weight, component (b) in amount of 0.5–12% by weight, component (c) in amount 0.5–20% by weight and component (d) in amount of 0–15% by weight.

3. A treating agent according to claim 1, in which component (b) is sodium aluminate.

4. A treating agent according to claim 1 in which component (b) is an aluminum salt selected from the group consisting of sodium aluminate, aluminum sulfate, aluminum ammonium sulfate, potassium aluminum sulfate, aluminum nitrate, aluminum acetate, aluminum fluoride, aluminum chloride, aluminum oxalate, and aluminum lactate.

5. A treating agent according to claim 4 in which component (b) is sodium aluminate.

6. A treating agent according to claim 1 in which component (b) is chromium sulfate.

7. A treating agent according to claim 1 in which component (b) is zirconium sulfate.

8. A treating agent composition for leather, fur and fibrous material according to claim 1 or 2, which additionally contains copper powder.

9. A treating agent composition for leather, fur and fibrous material according to claim 8, wherein the content of said copper powder is 0.03–15% by weight based on the weight of the treating agent composition.

10. A method for giving a dimensional stability and a shrink resistance to leather, fur and fibrous material which comprises treating the leather, fur and fibrous material with a treating agent composition according to claim 1 or 2.

* * * * *